US007285763B2

(12) United States Patent
Ozaki

(10) Patent No.: US 7,285,763 B2
(45) Date of Patent: Oct. 23, 2007

(54) VIDEO DATA CORRECTION CIRCUIT, DISPLAY DEVICE AND ELECTRONIC APPLIANCE

(75) Inventor: Tadafumi Ozaki, Gifu (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 165 days.

(21) Appl. No.: 11/258,364

(22) Filed: Oct. 26, 2005

(65) Prior Publication Data

US 2006/0092108 A1 May 4, 2006

(30) Foreign Application Priority Data

Oct. 29, 2004 (JP) ..... 2004-315163

(51) Int. Cl.
*G09G 3/30* (2006.01)

(52) U.S. Cl. ..... 250/205; 345/76; 345/82; 345/84

(58) Field of Classification Search ..... 250/205; 345/76, 77, 78, 81, 82, 83, 92
See application file for complete search history.

(56) References Cited

U.S. PATENT DOCUMENTS 5,247,190 A 9/1993 Friend et al.
5,399,502 A 3/1995 Friend et al.

(Continued)

FOREIGN PATENT DOCUMENTS

JP 11-305722 11/1999
JP 2002-175041 6/2002
JP 2003-202838 7/2003
JP 2004-029715 1/2004

OTHER PUBLICATIONS

Shimoda et al., SID Digest '99: SID International Symposium Digest of Technical Papers, "16.2: Invited Paper: Current Status and Future of Light-Emitting Polymer Display Driven By Poly-Si TFT," May 18, 1999, pp. 372-375.

(Continued)

*Primary Examiner*—Thanh X. Luu
*Assistant Examiner*—Stephen Yam
(74) *Attorney, Agent, or Firm*—Eric J. Robinson; Robinson Intellectual Property Law Office, P.C.

(57) ABSTRACT

A video correction circuit of the invention includes an detection unit for detecting the cumulative light-emission frequency data on each pixel by sampling video data supplied to a display device having a plurality of pixels; a cumulative data storage unit for storing the cumulative light-emission frequency data on each pixel; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The pixels are provided with light-emitting elements of a plurality of colors. The cumulative light-emission frequency data is divided into a plurality of data fragments, each of which is stored in each of the plurality of memories for each color of the light-emitting elements.

44 Claims, 16 Drawing Sheets

U.S. PATENT DOCUMENTS

| | | | | |
|---|---|---|---|---|
| 5,708,451 | A | 1/1998 | Baldi | |
| 5,778,146 | A | 7/1998 | Kawasaki et al. | |
| 6,127,991 | A | 10/2000 | Uehara et al. | |
| 6,219,017 | B1 | 4/2001 | Shimada et al. | |
| 6,249,268 | B1 | 6/2001 | Tachibana et al. | |
| 6,456,337 | B1 | 9/2002 | Kobayashi et al. | |
| 6,473,065 | B1 * | 10/2002 | Fan | 345/82 |
| 6,542,260 | B1 | 4/2003 | Gann et al. | |
| 6,618,084 | B1 | 9/2003 | Rambaldi et al. | |
| 6,628,848 | B1 | 9/2003 | Nakamura | |
| 2002/0033783 | A1 | 3/2002 | Koyama | |
| 2003/0063053 | A1 | 4/2003 | Yamazaki et al. | |
| 2003/0071804 | A1 | 4/2003 | Yamazaki et al. | |
| 2004/0046757 | A1 | 3/2004 | Yamada | |

OTHER PUBLICATIONS

Shimoda et al., ASIA Display '98, Proceedings of the 18th International Display Research Conference, High Resolution Light Emitting Polymer Display Driven by Low Temperature Polysilicon Thin Film Transistor with Integrated Driver, Jan. 1, 1998, pp. 217-220.

Han et al., EuroDisplay '99, Proceedings of the 19th International Display Research Conference Late-News Papers, "3.8 Green OLED with low temperature poly Si TFT," Sep. 6, 1999, pp. 27-30.

* cited by examiner

VIDEO DATA CORRECTION CIRCUIT, DISPLAY DEVICE AND ELECTRONIC APPLIANCE

BACKGROUND OF THE INVENTION

1. Field of the Invention

The present invention relates to a display device using light-emitting elements in a pixel portion, and more particularly to a display device using light-emitting elements typified by organic electroluminescence (EL) elements in a pixel portion, and is provided with a video data correction circuit for correcting video data correspondingly to the degradation of the light-emitting elements. In addition, the invention relates to a display panel where a light-emitting element such as an EL element is disposed in each pixel and a video data correction circuit for correcting the degradation of the light-emitting element is provided. Further, the invention relates to an electronic appliance provided with such a display device.

2. Description of the Related Art

In recent years, a display device using light-emitting elements where a semiconductor thin film is formed over an insulator such as a glass substrate, in particular an active matrix light-emitting device using TFTs (Thin Film Transistors) has been in widespread use. In the active matrix light-emitting device using TFTs, several hundred thousand to several million TFTs are disposed in a pixel portion where pixels are arranged in matrix, with which electric charge of each pixel is controlled for displaying images.

Further, in addition to the pixel TFTs which constitute the pixels, a driver circuit is simultaneously formed on the periphery of the pixel portion by using TFTs, which greatly contributes to the downsizing and lower power consumption of the device. Accordingly, the display device using light-emitting elements has become an essential device for a display portion of mobile devices and the like of which applications are increasing in recent years. In addition, by a crystallization technique for crystallizing a semiconductor film such as amorphous silicon over a glass substrate at low temperature, a high added value has been achieved such as a so-called SOG (System On Glass) in which a CPU and other modules are mounted over a glass substrate.

As an alternative display device for a liquid crystal display device (LCD), there is a display device having a display panel where a light-emitting element is disposed in each pixel and a peripheral circuit for inputting signals to the panel, which displays images by controlling the light emission of the light-emitting element.

Such a display device has a control circuit which converts a received video signal to the video data capable of displaying gray scales in the pixels of the display panel and outputs the video data to the panel together with a panel control signal. In the display panel of the display device, two or three TFTs (Thin Film Transistors) are typically disposed in each pixel, and by controlling on/off of these TFTs, current supplied to the light-emitting element in each pixel, namely the luminance and light emission/non-light emission of the light-emitting element in each pixel are controlled. Further, in the peripheral portion of the pixel portion of the panel, a driver circuit is provided for controlling on/off of the TFTs in each pixel. Such a driver circuit is constituted by TFTs which are formed simultaneously with the TFTs in the pixel portion. These TFTs may be either n-channel TFTs or p-channel TFTs.

At this time, in the case where an EL element or the like is used as the light-emitting element, current is constantly supplied and thus flows to the EL element in the period in which the EL element emits light. In the case where light emission of the EL element is performed with a current supply, luminous efficiency of R (Red), G (Green) and B (Blue) relatively to a driving current differs from each other depending on the material used for the organic EL element. Moreover, the luminous efficiency changes with time and degrades as the cumulative light-emission period (total light emission period) becomes longer, and the degradation characteristics with time differ depending on each light-emitting material. Accordingly, the property of the EL element per se degrades by the long period of light emission, which results in changes in the luminance characteristics. That is, when comparing an EL element which has degraded and an EL element which has not degraded, luminance difference occurs even when current is supplied with the same voltage from the same current supply source. In a display device using EL elements and the like, white light is expressed by the total emission state of the whole three primary colors of RGB; therefore, reddish or bluish white is displayed in accordance with changes in the light-emission state due to the degradation of each color with time. As a result, such a problem is posed that white balance is disrupted.

Therefore, among display devices using light-emitting elements such as EL elements, there is a display device provided with a video data correction circuit which regularly corrects video data signals for driving a pixel of which EL element has degraded, with which the light-emission time or the light-emission time and intensity of each EGB pixel is detected by regularly sampling video data signals, and the cumulative detected values are compared with the prestored data on changes with time of the luminance characteristics of the EL elements in order to keep uniform display screen without causing luminance unevenness even when EL elements in some pixels have degraded.

Note that sampling in this specification means the operation in which the light-emission time or the light-emission time and intensity of each color (RGB in this specification) of each pixel is regularly detected using video signals and the detected values are accumulated.

As such a video data correction circuit, for example, there is a self-luminous display device having a degradation correction function which is invented by the present applicant and disclosed in Patent Document 1. FIG. 13 shows a block diagram of such a video data correction circuit. The video data correction circuit includes I: counter unit, II: memory circuit unit and III: signal correction unit. I includes a counter 1302, II includes a volatile memory 1303 and a non-volatile memory 1304 and III includes a correction circuit 1305 and a correction data storage unit 1306. In the video data correction circuit, a first video signal 1301A as a pre-correction video data signal (video data for driving a pixel of which EL element has degraded) is corrected by the signal correction unit III, which is then supplied to a display device 1307 as a second video signal 1301B as a corrected video data signal.

In this video data correction circuit, the second video signal 1301B as a corrected video data signal which is regularly (for example, per second) supplied to the display device 1307 is sampled, and light emission/non-light emission of each pixel is counted by the counter 1302. The cumulative number and time of light emissions of each pixel counted therein are sequentially stored in the memory circuit unit II (hereinafter referred to as the cumulative time data). The memory circuit is desirably constructed using a non-volatile memory as the number of light emissions is accumulated; however, the non-volatile memory generally has a limitation in the number of data writings thereto. Thus, in the device of FIG. 13, data is stored by using the volatile memory 1303 during operation of the self-luminous device while data is written into the non-volatile memory 1304 at regular intervals (for example, every hour or at every shut down time of the power source). That is, upon the next power-on time, the light-emission time or the light-emission time and intensity of EL elements is counted again.

[Patent Document 1] Japanese Patent Laid-Open No. 2002-175041

Here, in order to write the cumulative time data from the counter 1302 into the volatile memory 1303 in one cycle of a reception clock (which corresponds to the clock for receiving video data in the video data correction circuit in this specification), the memory is accessed at the following 4 timings: the write-in operation of the cumulative time data to the volatile memory; the readout operation for outputting the cumulative time data on R from the volatile memory to the signal correction unit; the readout operation for outputting the cumulative time data on G from the volatile memory to the signal correction unit; and the readout operation for outputting the cumulative time data on B from the volatile memory to the signal correction unit. At this time, there is only a short time between the write-in timing of the cumulative time data to the volatile memory and the output timing of the cumulative time data from the volatile memory to the signal correction unit. Thus, in order to prevent the write-in timing and the output timing form overlapping with each other, a time margin (blank period) is required to be provided for avoiding mixture of data.

As set forth above, in the case of accumulating/adding or multiplying the light-emission time of light-emitting elements, each operation timing is difficult to set in one cycle of a reception clock during which the write-in operation and the output operation of the cumulative time data are performed. Therefore, a time margin is desirably provided for preventing mixture of data. Additionally, in accordance with the enlargement of a panel in recent years, a volume of video data signals is increased, which requires a storage medium capable of high-speed operation. Thus, a time margin is still required.

In order to secure such a margin, it is required that a volatile memory and a non-volatile memory mounted on a circuit have higher capacity and operate at faster speed. However, the number of connection pins in the mounted circuit is increased as well as an area occupied by the circuit is increased in accordance with the increase in the number of bits, which obstructs the downsizing and realization of the lower manufacturing cost of a product. In addition, when the number of high-capacity RAMs is increased, lower power consumption becomes difficult to achieve.

SUMMARY OF THE INVENTION

The invention is made in view of the aforementioned problems of the conventional technique, and it is a primary object of the invention to provide a video data correction circuit and a display device and electronic appliance incorporating the same, where the downsizing and lower manufacturing cost of a product can be achieved as well as the lower power consumption and high-speed operation are achieved, by securing a margin for the memory access timing without using a high-capacity and high-speed operation memory even when the volume of video data signals is increased.

According to the invention, the cumulative light-emission frequency data (cumulative data on the light-emission time or the light-emission time and intensity or the like) of each pixel which is inputted to a video data correction circuit is divided into a plurality of data fragments, and the plurality of data fragments are stored in a plurality of memories for each color of light-emitting elements, thereby a video data correction circuit can be provided where a margin for memory access timing can be secured without the need for a high-capacity and high-speed operation memory.

More specifically, a video data correction circuit of the invention includes an detection unit for detecting cumulative light-emission frequency data on each pixel by sampling video data supplied to a display device having a plurality of pixels; a cumulative data storage unit for storing the cumulative light emission frequency data on each pixel in a plurality of memories; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into a plurality of data fragments, and the plurality of data fragments are stored in each of the plurality of memories for each color of the pixels.

Another video data correction circuit of the invention includes an detection unit for detecting cumulative light-emission frequency data on each pixel by sampling video data supplied to a display device having a plurality of pixels; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into first cumulative light-emission frequency data and second cumulative light-emission frequency data. Each of the first cumulative light-emission frequency data and the second cumulative light-emission frequency data is stored in one of the first memory and the second memory for each color of the pixels.

Another video data correction circuit of the invention includes an detection unit for detecting cumulative light-emission frequency data on each pixel by sampling video data supplied to a display device having a plurality of pixels; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device.

The cumulative light-emission frequency data is divided into first cumulative light-emission frequency data and second cumulative light-emission frequency data. Each of the first cumulative light-emission frequency data and the second cumulative light-emission frequency data is stored in one of the first volatile memory and the second volatile memory for each color of the pixels.

Another video data correction circuit of the invention includes an detection unit for detecting cumulative light-emission frequency data on each pixel by sampling video data supplied to a display device having a plurality of pixels; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into a high-order bit and a low-order bit of the cumulative light-emission frequency data. Each of the high-order bit and the low-order bit is stored in one of the first volatile memory and the second volatile memory for each color of the pixels.

Another video data correction circuit of the invention includes an detection unit for detecting cumulative light-emission frequency data on each pixel by sampling video data supplied to a display device having a plurality of pixels; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into a high-order bit and a low-order bit of the cumulative light-emission frequency data. Each of the high-order bit and the low-order bit is stored in one of the first volatile memory and the second volatile memory for each color of the pixels, and a degradation correction coefficient for correcting the video data in the correction unit is multiplied by only the high-order bit of the cumulative light-emission frequency data.

The cumulative light-emission frequency data on each pixel may be either the cumulative data on the light-emission time of each pixel or the cumulative data on the light-emission time and intensity of each pixel.

Each of the pixels may be provided with a light-emitting element of one of red, blue and green colors.

Among the light-emitting elements of the three colors of red, blue and green, the cumulative light-emission frequency data on two colors may be stored in the first volatile memory while the cumulative light-emission frequency data on one color may be stored in the second volatile memory.

By applying the invention to a display device having a pixel portion and a video data correction circuit, a display device can be provided where a margin for memory access timing can be secured without the need for a high-capacity and high-speed operation memory.

More specifically, a display device of the invention includes a gate signal line driver circuit; a source signal line driver circuit; a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a plurality of memories; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into a plurality of data fragments, and the plurality of data fragments are stored in each of the plurality of memories for each color of the pixels, thereby video data is corrected.

Another display device of the invention includes a gate signal line driver circuit; a source signal line driver circuit; a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into first cumulative light-emission frequency data and second cumulative light-emission frequency data, and each of the first cumulative light-emission frequency data and the second cumulative light-emission frequency data is stored in one of the first memory and the second memory for each color of the pixels, thereby video data is corrected.

More specifically, a display device of the invention includes a gate signal line driver circuit; a source signal line driver circuit; a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into first cumulative light-emission frequency data and second cumulative light-emission frequency data, and each of the first cumulative light-emission frequency data and the second cumulative light-emission frequency data is stored in one of the first volatile memory and the second volatile memory for each color of the pixels, thereby video data is corrected.

Another display device of the invention includes a gate signal line driver circuit; a source signal line driver circuit; a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into a high-order bit and a low-order bit of the cumulative light-emission frequency data, and each of the high-order bit and the low-order bit is stored in one of the first volatile memory and the second volatile memory for reach color of the pixels, thereby video data is corrected.

Another display device of the invention includes a gate signal line driver circuit; a source signal line driver circuit; a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into a high-order bit and a low-order bit of the cumulative light-emission frequency data, and each of the high-order bit and the low-order bit is stored in one of the first volatile memory and the second volatile memory for each color of the pixels. A degradation correction coefficient for correcting the video data in the correction unit is multiplied by only the high-order bit of the cumulative light-emission frequency data, thereby video data is corrected.

The cumulative light-emission frequency data on each pixel may be either the cumulative data on the light-emission time of each pixel or the cumulative data on the light-emission time and intensity of each pixel.

Each of the pixels may be provided with a light-emitting element of one of red, blue and green colors.

Among the light-emitting elements of the three colors of red, blue and green, the cumulative light-emission frequency data on two colors may be stored in the first volatile memory while the cumulative light-emission frequency data on one color may be stored in the second volatile memory.

By applying the invention to an electronic appliance having a display panel and a video data correction circuit, a display device can be provided where a margin for memory access timing can be secured without the need for a high-capacity and high-speed operation memory.

More specifically, an electronic appliance of the invention includes a gate signal line driver circuit; a source signal line driver circuit; a display panel provided with a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a plurality of memories; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into a plurality of data fragments, and the plurality of data fragments are stored in each of the plurality of memories for each color of the pixels, thereby video data is corrected.

Another electronic appliance of the invention includes a gate signal line driver circuit; a source signal line driver circuit; a display panel provided with a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into first cumulative light-emission frequency data and second cumulative light-emission frequency data, and each of the first cumulative light-emission frequency data and the second cumulative light-emission frequency data is stored in one of the first memory and the second memory for each color of the pixels, thereby video data is corrected.

Another electronic appliance of the invention includes a gate signal line driver circuit; a source signal line driver circuit; a display panel provided with a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into first cumulative light-emission frequency data and second cumulative light-emission frequency data, and each of the first cumulative light-emission frequency data and the second cumulative light-emission frequency data is stored in one of the first volatile memory and the second volatile memory for each color of the pixels, thereby video data is corrected.

Another electronic appliance of the invention includes a gate signal line driver circuit; a source signal line driver circuit; a display panel provided with a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into a high-order bit and a low-order bit of the cumulative light-emission frequency data, and each of the high-order bit and the low-order bit is stored in one of the first volatile memory and the second volatile memory for each color of the pixels, thereby video data is corrected.

Another electronic appliance of the invention includes a gate signal line driver circuit; a source signal line driver circuit; a display panel provided with a pixel portion having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into a high-order bit and a low-order bit of the cumulative light-emission frequency data, and each of the high-order bit and the low-order bit is stored in one of the first volatile memory and the second volatile memory for each color of the pixels. A degradation correction coefficient for correcting the video data in the correction unit is multiplied by only the high-order bit of the cumulative light-emission frequency data, thereby video data is corrected.

The cumulative light-emission frequency data on each pixel may be either the cumulative data on the light-emission time of each pixel or the cumulative data on the light-emission time and intensity of each pixel.

Each of the pixels may be provided with a light-emitting element of one of red, blue and green colors.

Among the light-emitting elements of the three colors of red, blue and green, the cumulative light-emission frequency data on two colors may be stored in the first volatile memory while the cumulative light-emission frequency data on one color may be stored in the second volatile memory.

The electronic appliance of the invention includes a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

According to another mode of the invention, the cumulative light-emission frequency data on each pixel (cumulative data on the light-emission time or the light-emission and intensity) which is inputted to the video data correction circuit is divided into a plurality of data fragments, and the plurality of data fragments are stored in the plurality of memories for each pixel of display areas, thereby a margin for memory access timing can be secured without the need for a high-capacity and high-speed operation memory, and thus sampling can be performed with less frames of a frame clock.

More specifically, a video data correction circuit of the invention includes an detection unit for detecting cumulative light-emission frequency data on each pixel by sampling video data supplied to a display device having a plurality of display areas each including a plurality of pixels; a cumulative data storage unit for storing the cumulative light-emission frequency data on each pixel in a plurality of memories; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency light-emission frequency data; and a correction unit for correcting the video data based on the cumulative light-emission frequency data stored in the cumulative data storage unit, thereby outputting the corrected video data to the display device. The cumulative light-emission frequency data is divided into a plurality of data fragments, and the plurality of data fragments are stored in each of the plurality of memories for each pixel of the display areas.

Another video data correction circuit of the invention includes an detection unit for detecting cumulative light-emission frequency data on each pixel by sampling video data supplied to a display device having a first display area and a second display area each having a plurality of pixels; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into first cumulative light-emission frequency data and second cumulative light-emission frequency data, and each of the first cumulative light-emission frequency data and the second cumulative light-emission frequency data is stored in one of the first memory and the second memory for each pixel of the first display area and the second display area.

Another video data correction circuit of the invention includes an detection unit for detecting cumulative light-emission frequency data on each pixel by sampling video data supplied to a display device having a first display area and a second display area each having a plurality of pixels; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into first cumulative light-emission frequency data and second cumulative light-emission frequency data, and each of the first cumulative light-emission frequency data and the second cumulative light-emission frequency data is stored in one of the first volatile memory and the second volatile memory for each pixel of the first display area and the second display area.

Another video data correction circuit of the invention includes an detection unit for detecting cumulative light-emission frequency data on each pixel by sampling video data supplied to a display device having a first display area and a second display area each having a plurality of pixels; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into a high-order bit and a low-order bit of the cumulative light-emission frequency data, and each of the high-order bit and the low-order bit is stored in one of the first volatile memory and the second volatile memory for each pixel of the first display area and the second display area.

Another video data correction circuit of the invention includes an detection unit for detecting cumulative light-emission frequency data on each pixel by sampling video data supplied to a display device having a first display area and a second display area each having a plurality of pixels; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display device. The cumulative light-emission frequency data is divided into a high-order bit and a low-order bit of the cumulative light-emission frequency data, and each of the high-order bit and the low-order bit is stored in one of the first volatile memory and the second volatile memory for each pixel of the first display area and the second display area. A degradation correction coefficient for correcting the video data in the correction unit is multiplied by only the high-order bit of the cumulative light-emission frequency data.

The cumulative light-emission frequency data on each pixel may be either the cumulative data on the light-emission time of each pixel or the cumulative data on the light-emission time and intensity of each pixel.

The first display area may be an area where odd-numbered video data inputted to the display device is displayed, and the second display area may be an area where even-numbered video data inputted to the display device is displayed.

By applying the invention to a display device having a pixel portion and a video data correction circuit, a display device can be provided where a margin for memory access timing can be secured without the need for a high-capacity and high-speed operation memory.

More specifically, a display device of the invention includes a pixel portion having a plurality of display areas each having a plurality of pixels for displaying images, which is connected to a gate signal line driver circuit and a source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a plurality of memories; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into a plurality of data fragments, and the plurality of data fragments are stored in each of the plurality of memories for each pixel of the display areas, thereby video data is corrected.

Another display device of the invention includes a gate signal line driver circuit; a source signal line driver circuit; a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into first cumulative light-emission frequency data and second cumulative light-emission frequency data, and each of the first cumulative light-emission frequency data and the second cumulative light-emission frequency data is stored in one of the first memory and the second memory for each pixel of the first display area and the second display area, thereby video data is corrected.

Another display device of the invention includes a gate signal line driver circuit; a source signal line driver circuit; a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into first cumulative light-emission frequency data and second cumulative light-emission frequency data, and each of the first cumulative light-emission frequency data and the second cumulative light-emission frequency data is stored in one of the first volatile memory and the second volatile memory for each pixel of the first display area and the second display area, thereby video data is corrected.

Another display device of the invention includes a gate signal line driver circuit; a source signal line driver circuit; a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into an upper bit and a lower bit of the cumulative light-emission frequency data, and each of the upper bit and the lower bit is stored in one of the first volatile memory and the second volatile memory for each pixel of the first display area and the second display area, thereby video data is corrected.

Another display device of the invention includes a gate signal line driver circuit; a source signal line driver circuit; a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the pixel portion. The cumulative light-emission frequency data is divided into an upper bit and a lower bit of the cumulative light-emission frequency data, and each of the upper bit and the lower bit is stored in one of the first volatile memory and the second volatile memory for each pixel of the first display area and the second display area. A degradation correction coefficient for correcting the video data in the correction unit is multiplied by only the high-order bit of the cumulative light-emission frequency data, thereby video data is corrected.

The cumulative light-emission frequency data on each pixel may be either the cumulative data on the light-emission time of each pixel or the cumulative data on the light-emission time and intensity of each pixel.

The first display area may be an area where the odd-numbered video data inputted to the pixel portion is displayed, and the second display area may be an area where the even-numbered video data inputted to the pixel portion is displayed.

By applying the invention to an electronic appliance having a display panel and a video data correction circuit, an electronic appliance can be provided where a margin for memory access timing can be secured without the need for a high-capacity and high-speed operation memory.

More specifically, an electronic appliance of the invention includes a gate signal line driver circuit; a source signal line driver circuit; a display panel provided with a pixel portion having a plurality of display areas each including a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a plurality of memories; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into a plurality of data fragments, and the plurality of data fragments are stored in each of the plurality of memories for each pixel of the display areas, thereby video data is corrected.

Another electronic appliance of the invention includes a gate signal line driver circuit; a source signal line driver circuit; a display panel provided with a pixel portion having a first display area and a second display area each having a plurality of pixels for displaying images, which is connected to the gate signal line driver circuit and the source signal line driver circuit, and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first memory and a second memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into first cumulative light-emission frequency data and second cumulative light-emission frequency data, and each of the first cumulative light-emission frequency data and the second cumulative light-emission frequency data is stored in one of the first memory and the second memory for each pixel of the first display area and the second display area, thereby video data is corrected.

Another electronic appliance of the invention includes a gate signal line driver circuit; a source signal line driver circuit; a display panel provided with a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into first cumulative light-emission frequency data and second cumulative light-emission frequency data, and each of the first cumulative light-emission frequency data and the second cumulative light-emission frequency data is stored in one of the first volatile memory and the second volatile memory for each pixel of the first display area and the second display area, thereby video data is corrected.

Another electronic appliance of the invention includes a gate signal line driver circuit; a source signal line driver circuit; a display panel provided with a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into a high-order bit and a low-order bit of the cumulative light-emission frequency data, and each of the first cumulative light-emission frequency data and the second cumulative light-emission frequency data is stored in one of the first volatile memory and the second volatile memory for each pixel of the first display area and the second display area, thereby video data is corrected.

Another electronic appliance of the invention includes a gate signal line driver circuit; a source signal line driver circuit; a display panel provided with a pixel portion having a first display area and a second display area each having a plurality of pixels for displaying images, which is connected to the gate signal line driver circuit and the source signal line driver circuit; and a video data correction circuit for correcting video data to be inputted to the gate signal line driver circuit and the source signal line driver circuit. The video data correction circuit includes an detection unit for detecting cumulative light-emission frequency data on each of the plurality of pixels by sampling the video data supplied to each pixel; a cumulative data storage unit for storing the cumulative light-emission frequency data on each pixel in a first volatile memory and a second volatile memory; an adder for adding the cumulative light-emission frequency data on each pixel detected by the detection unit to the cumulative light-emission frequency data on each pixel stored in the cumulative data storage unit, thereby writing the result to the cumulative data storage unit as new cumulative light-emission frequency data; and a correction unit for correcting the video data based on the cumulative light-emission frequency data stored in the cumulative data storage unit, thereby outputting the corrected video data to the display panel. The cumulative light-emission frequency data is divided into a high-order bit and a low-order bit of the cumulative light-emission frequency data, and each of the high-order bit and the low-order bit is stored in one of the first volatile memory and the second volatile memory for each pixel of the first display area and the second display area. A degradation correction coefficient for correcting the video data in the correction unit is multiplied by only the high-order bit of the cumulative light-emission frequency data, thereby video data is corrected.

The cumulative light-emission frequency data on each pixel may be either the cumulative data on the light-emission time of each pixel or the cumulative data on the light-emission time and intensity of each pixel.

The first display area may be an area where odd-numbered video data inputted to the display panel is displayed, and the second display area may be an area where even-numbered video data inputted to the display panel is displayed.

The electronic appliance of the invention includes a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

According to the invention, in the operation for reading out a high-order bit of the light-emission cumulative time data from volatile memories in each frame of a reception cycle for storing the light-emission cumulative time data in the volatile memory memories by counting the light-emission time of light-emitting elements, RGB are read out simultaneously but separately in such a manner that two colors and one color are read out from two volatile memories respectively. Therefore, a margin for access timing can be secured by reducing the number of readout accesses to memories in one frame of a reception clock. Accordingly, the reliability of the circuit can be drastically improved. In addition, the invention can also be applied to shorter reception cycles without requiring the higher capacity or higher operation speed of memories. Thus, the invention can contribute to the downsizing, low power consumption and lower cost of a product.

In addition, according to the invention, in the operation for reading out a high-order bit of the light-emission cumulative time data from volatile memories in each frame of a reception cycle for storing the light-emission cumulative time data in the non-volatile memories by counting the light-emission time of light-emitting elements, the cumulative time data on a pixel to which the odd-numbered video data is inputted and the cumulative time data on a pixel to which the even-numbered video data is inputted are simultaneously read out from two volatile memories. Thus, a margin for access timing can be secured by reducing the number of readout accesses to memories in one frame of a reception clock in this operation. Therefore, the capacity and the operation speed of memories are not required to be increased. Further, since the light-emission time of the pixel to which the odd-numbered video data is inputted and the pixel to which the even-numbered video data is inputted can be counted in parallel in one frame of a frame clock, the number of memory accesses can be drastically reduced. Thus, the invention can contribute to the downsizing, lower power consumption and lower cost of a product.

The invention is effective particularly for obtaining the higher capacitance of video data inputted to a display portion, and thus can greatly contribute to an enlargement of a panel.

DETAILED DESCRIPTION OF THE INVENTION

Embodiment Mode 1

Figure 1:
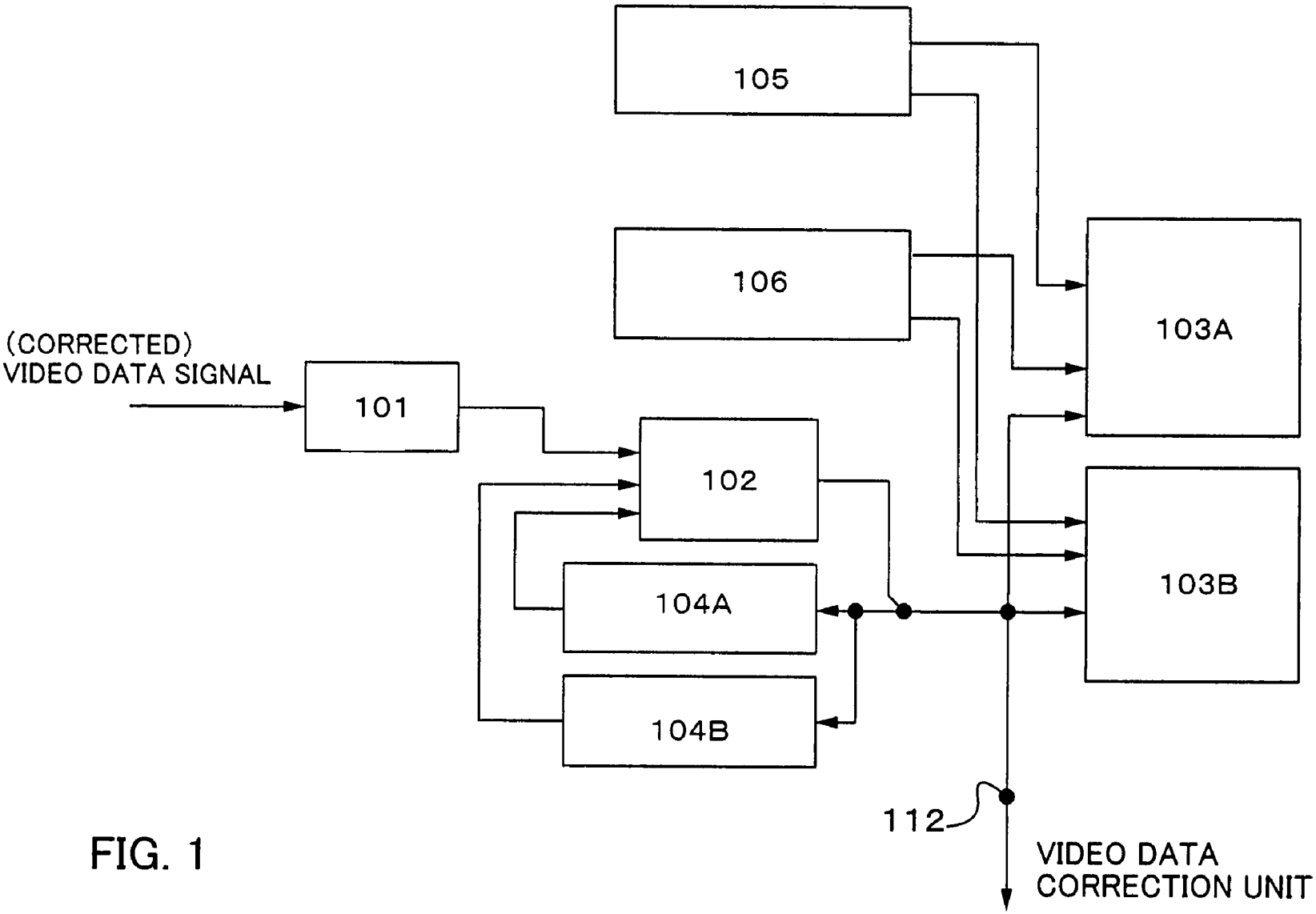
FIG. 1 is a block diagram showing a configuration example of a light-emission time accumulator in accordance with Embodiment Mode 1.

FIG. 1 is a schematic diagram showing a configuration example of a light-emission time accumulator of a video data correction circuit in accordance with the invention. This light-emission time accumulator includes a latch circuit 101 for latching video data to be sampled, an adder 102 for generating new cumulative time data by adding the light-emission time predicted from the sampled video data to the previously stored cumulative time data, an RG volatile memory unit 103A as a first volatile memory for storing the cumulative time data, and a B volatile memory unit 103B as a second volatile memory for storing the cumulative time data. Although a volatile memory is exemplarily shown as the first volatile memory unit and the second volatile memory unit, a non-volatile memory may be used for one or both of the memory units. Further, more memory units may be provided. Note that the video data inputted to the latch circuit 101 corresponds to the corrected video data to be actually outputted to the display portion.

As a controller of both the RG volatile memory unit 103A and the B volatile memory unit 103B, a volatile memory unit address generating circuit 105 and a volatile memory unit control circuit 106 are provided. Further, the adder 102 is provided with a high-order-bit storage register 104A for reading out the cumulative time data from the RG volatile memory unit 103A and the B volatile memory unit 103B to be added to the sampled video data and temporarily storing it, and a low-order-bit register 104B for similarly reading out the cumulative time data from the RG volatile memory unit 103A and the B volatile memory unit 103B and temporarily storing it. Note that in this embodiment mode, a display device to be supplied with video data has a plurality of pixels each of which includes an R (Red), G (Green) or B (Blue) light-emitting element, and images are displayed by utilizing the light emission of each R, G or B light-emitting element in each pixel.

In the video data correction circuit of the invention, the RG volatile memory unit 103A and the B volatile memory unit 103B as the volatile memories used for accumulating the light-emission time of pixels are assigned with the video data on R and G pixels and the video data on B pixels respectively, thereby the cumulative time data is stored therein. Note that in this embodiment mode, the cumulative time data is divided into a high-order bit and a low-order bit, and the RG volatile memory unit 103A stores a high-order bit and a low-order bit of the cumulative time data on R and G pixels while the B volatile memory unit 103B stores a high-order bit and a low-order bit of the cumulative time data on B pixels. However, how to divide the cumulative time data on RGB pixels to be partially assigned to each volatile memory unit is not limited to the mode in which the video data on RGB pixels is divided into the video data on R and G pixels and the video data on B pixels. For example, such a mode can be employed that the cumulative time data on RGB pixels is divided into the video data on G and B pixels and the video data of R pixels, and assigned to a GB volatile memory unit and an R volatile memory unit respectively. Note that the invention can be applied not only to the case where video data has three colors of RGB but can be applied to the case where images are displayed with four or more colors, in which case the cumulative time data is stored in each volatile memory unit.

Figure 2:
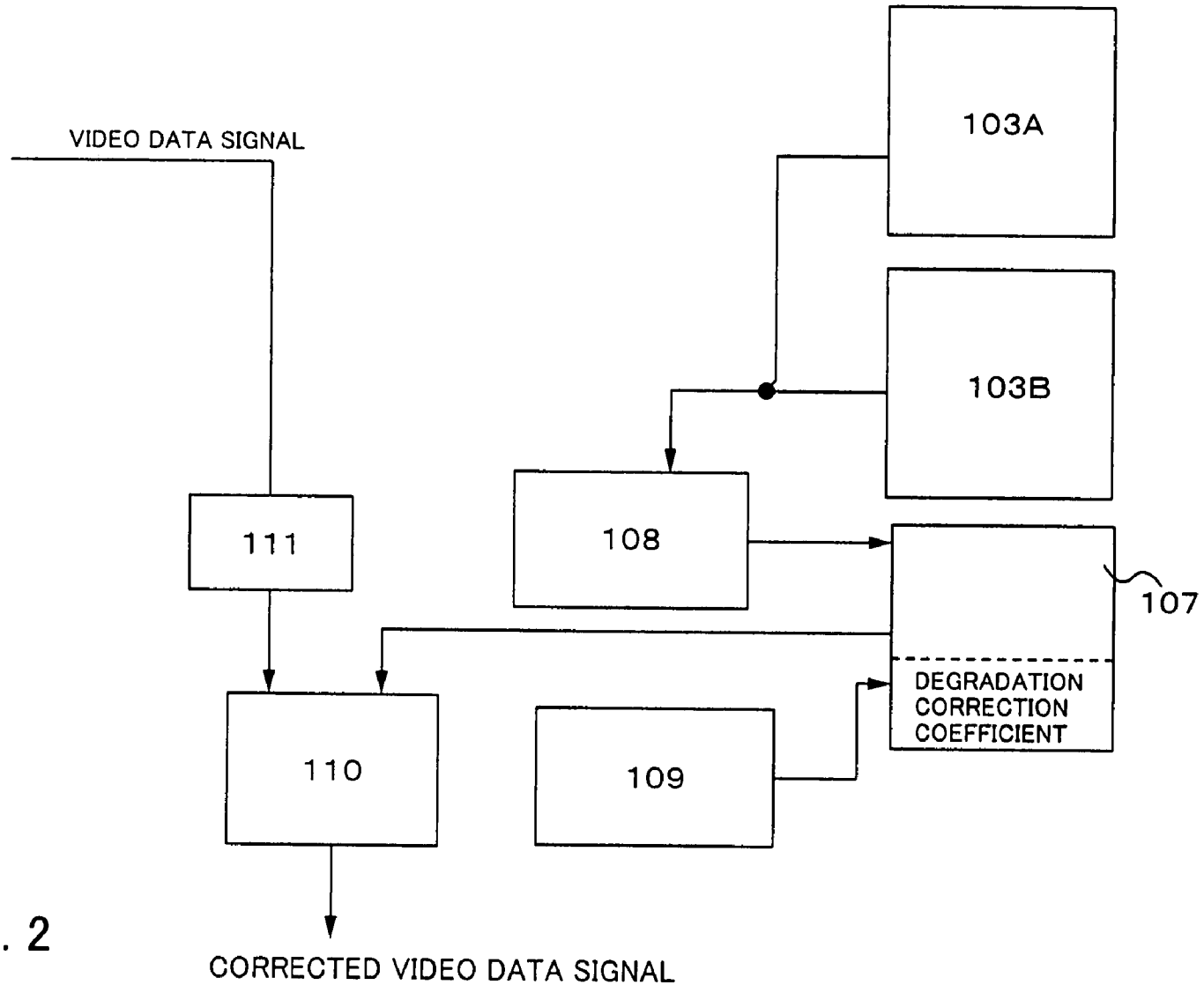
FIG. 2 is a block diagram showing configuration example of a video data correction unit in accordance with Embodiment Mode 1.

FIG. 2 is a schematic diagram showing a configuration example of a video data correction unit of a video data correction circuit in accordance with the invention. This video data correction unit stores degradation correction coefficients, and is provided with a non-volatile memory unit 107 as a non-volatile memory for backing up the content of the RG volatile memory unit 103A and the B volatile memory unit 103B when the power is off, and a multiplier 110 for generating corrected video data obtained by multiplying video data by a degradation correction coefficient corresponding to the cumulative light-emission time of each pixel. In addition, a non-volatile memory address generating circuit 108 and a non-volatile memory unit control circuit 109 are provided as a controller of the non-volatile memory unit 107, each of which controls the non-volatile memory unit using an address bus and a memory control signal. Note that a delay circuit 111 may be provided when multiplying the pre-correction video data by a degradation correction coefficient in the multiplier 110. By providing the delay circuit, video data input can be synchronized with the output of a degradation correction coefficient.

Description is made on the operation of the aforementioned video data correction circuit. First, data on changes with time of the luminance characteristics of a light-emitting element of a display device typified by an EL element is prestored in the non-volatile memory unit 107 as a degradation correction coefficient for correcting video data in accordance with the degree of degradation so as to eliminate the influence of the degradation. As an alternative configuration, another circuit unit for prestoring a degradation correction coefficient may be provided, such as a degradation correction coefficient storage register for storing data on changes with time of the luminance characteristics of a light-emitting element of a display device.

Note that in this embodiment mode, the degradation correction coefficient for correcting the luminance of a light-emitting element is calculated by using Formula 1. In Formula 1, t is a light-emission cumulative time, $K_0$ is the ideal luminance, K(t) is the luminance at the light-emission cumulative time t, and a(t) is a degradation correction coefficient at the light-emission cumulative time t.

$$K_0=a(t)\times K(t). \quad \text{[Formula 1]}$$

Video data (VD) inputted to the video data correction circuit is regularly sampled in the latch circuit 101, and the number of light emissions/non-light emissions in each pixel which is counted based on the video data is sequentially stored in a divided data form into the RG volatile memory unit 103A and the B volatile memory unit 103B respectively. The aforementioned regular sampling is performed once a second in this embodiment mode.

Figure 3:
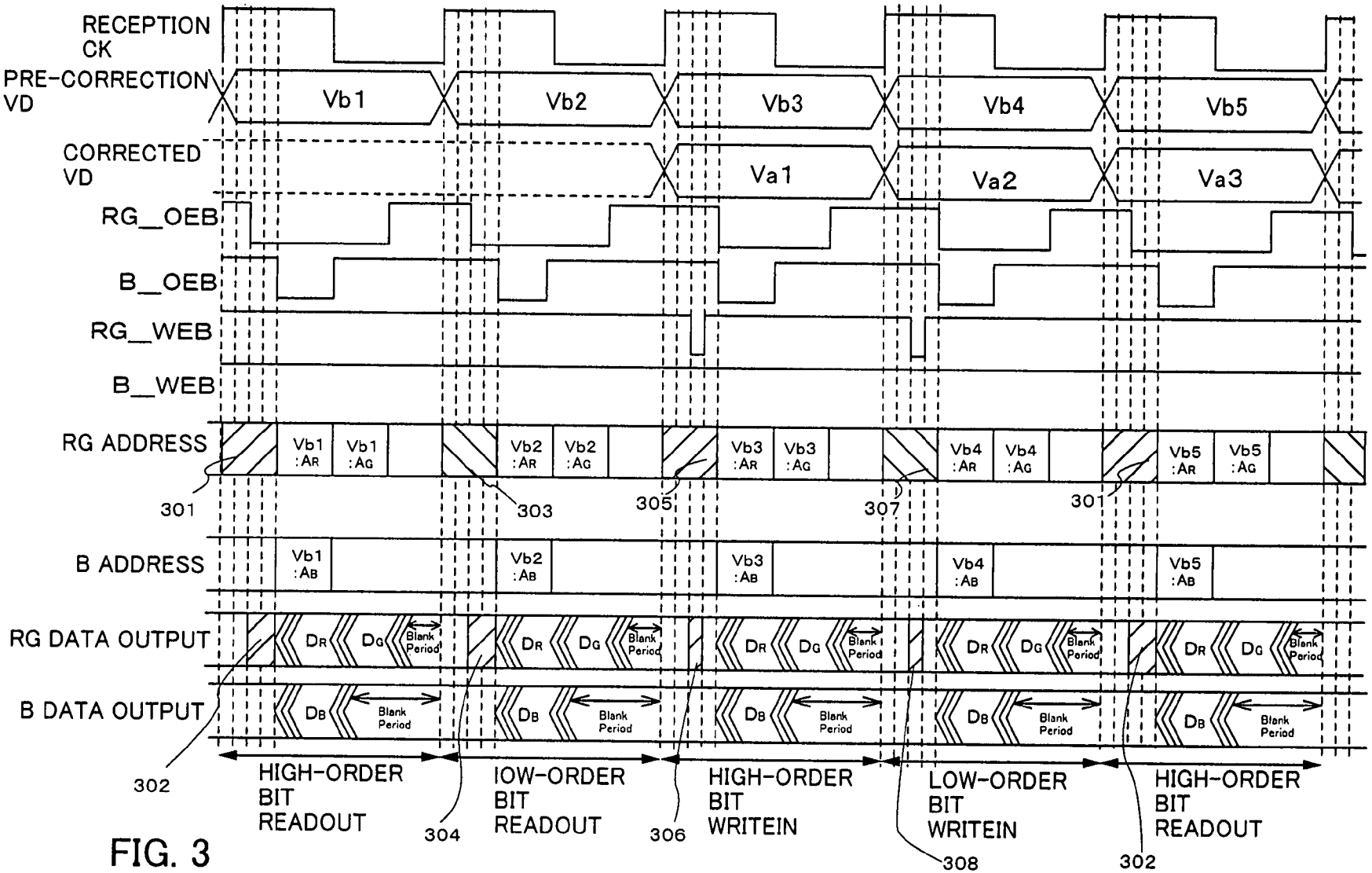
FIG. 3 is a timing chart in accordance with Embodiment Mode 1.

Here, FIG. 3 shows a timing chart of a reception clock (hereinafter, reception CK), a pre-correction video data signal (hereinafter, pre-correction VD: Vb1, Vb2, . . . ) a corrected video data signal (hereinafter, corrected VD: Va1, Va2, . . . ), an RG readout control signal (hereinafter, RG_OEB), a B readout control signal (hereinafter, B_OEB), an RG write-in control signal (hereinafter, RG_WEB), a B write-in control signal (hereinafter, B_WEB), an RG volatile memory unit address (hereinafter, RG address: $A_R$ and $A_G$), a B volatile memory unit address (hereinafter, B address: $A_B$), an output of the RG light-emission time cumulative data (hereinafter, RG data output: $D_R$ and $D_G$), and an output of the B light-emission time cumulative data (hereinafter, B data output: $D_B$), which are used in the light-emission time accumulator of the invention.

Description is made briefly on the write-in/readout operation to/from the RG volatile memory unit 103A or the B volatile memory unit 103B. When the RG_OEB is at High or Low (Low in this specification), video data can be read out from the RG volatile memory unit 103A and when the B_OEB is at High or Low (Low in this specification), video data can be read out from the B volatile memory unit 103B. Meanwhile, when the RG_WEB is at High or Low (Low in this specification), video data can be written into the RG volatile memory unit 103A and when the B_WEB is at High or Low (Low in this specification), video data can be written into the B volatile memory unit 103B. As shown in FIG. 3, the high-order-bit time cumulative data on R is read out form the RG volatile memory unit 103A in the period when the RG address is specified and the RG_OEB is at Low.

Although the sampling of each color of pixels is carried in the order of R→G→B in this embodiment mode, it is needless to mention that the invention is not limited to this sampling order, and the sampling may be performed by appropriately changing the order. For example, it may be G→R→B or other orders.

Referring now to FIGS. 1 to 3 with time on the sampling of a pre-correction VD, in the first cycle of a reception cycle CK, the RG_OEB is set Low in order to read out the high-order-bit time cumulative data (pre-correction video data Vb1 in this embodiment mode) on a predetermined pixel of a predetermined color (R in this embodiment mode) of a pre-correction VD. In synchronization with this, a high-order-bit time cumulative readout address 301 is specified in the RG address while high-order-bit time cumulative readout data 302 on R is stored in the high-order-bit storage register 104A.

Then, in the second cycle of the reception CK, the RG_OEB is set Low in order to read out the low-order-bit time cumulative data on a predetermined pixel of a predetermined color (R in this embodiment mode) of a pre-correction VD. In synchronization with this, a low-order-bit time cumulative readout address 303 is specified in the RG address while R low-order-bit time cumulative readout data 304 on R is stored in the low-order-bit storage register 104B.

Then, in the third cycle of the reception CK, the high-order-bit time cumulative readout data 302 on R which is stored in the high-order-bit storage register 104A is outputted to the adder 102, which is synchronously added to the light-emission data on R of the pre-correction video data Vb1 with a latch or the like (not shown). In addition, in order to write the added high-order-bit write-in data 306 on R into the RG volatile memory unit 103A, a high-order-bit time cumulative address 305 is specified in the RG address, and in synchronization with this, the RG_WEB is set Low.

Then, in the fourth cycle of the reception CK, the low-order-bit time cumulative readout data 304 on R which is stored in the low-order-bit storage register 104B is inputted to the adder 102, which is synchronously added to the cumulative time data on R of the pre-correction video data Vb1 with a latch or the like (not shown). In order to write the added low-order-bit time cumulative write-in data 308 on R into the RG volatile memory unit 103A, a low-order-bit time cumulative write-in address 307 is specified in the RG address, and in synchronization with this, the RG_WEB is set Low.

As set forth above, the time cumulative data on R color of the VD1 is accumulated in the RG volatile memory unit 103A by using 1 to 4 cycles of a reception clock. When sampling G, an operation similar to the R sampling operation may be performed. In addition, when sampling B, the sampling may be appropriately performed by separating each of the readout operation and the write-in operation from/to the B volatile memory unit into a high-order bit and a low-order bit in accordance with the B_OEB and B_WEB.

In order to perform the aforementioned sampling of the pre-correction video data to the whole colors of pixels so that the sampled time cumulative data is multiplied by a degradation correction coefficient to obtain video data to be inputted to the display portion, the video data is outputted to the non-volatile memory unit address generating circuit of the video data correction unit from the RG volatile memory unit and the B volatile memory unit through a node 112 in FIG. 1 in accordance with each frequency of a reception clock.

Here, description is made on the write-in operation of the high-order-bit time cumulative data on R into the RG volatile memory unit, in which the high-order-bit time cumulative data on R is written into the RG non-volatile memory unit or the G non-volatile memory unit, and the high-order-bit time cumulative data from the RG volatile memory unit and the B volatile memory unit are outputted to the video data correction unit of the high-order-bit time cumulative data.

In the case of writing the high-order-bit time cumulative data on R into the RG volatile memory unit, the memory is accessed at the following 3 timings: the write-in operation of the high-order-bit cumulative time data on R into the RG volatile memory unit; the readout operation for outputting the high-order-bit time cumulative data on R from the RG volatile memory unit to a multiplier, and for outputting the high-order-bit time cumulative data on B from the B volatile memory unit to the multiplier; and the readout operation for outputting the high-order-bit time cumulative data on G from the RG volatile memory unit to the multiplier, thus the memory access timing may be less than the conventional 4 times. At this time, by separately providing the RG volatile memory unit and the B volatile memory unit, the high-order-bit light-emission time cumulative data on R can be outputted from the RG volatile memory unit simultaneously with the high-order-bit light-emission time cumulative data on B being outputted from the B volatile memory unit. In addition, the remaining data on G may be appropriately outputted after outputting the light-emission time cumulative data on R as shown in FIG. 3. Accordingly, a blank period is secured as shown in FIG. 3 as compared to the conventional access timing.

Figure 14:
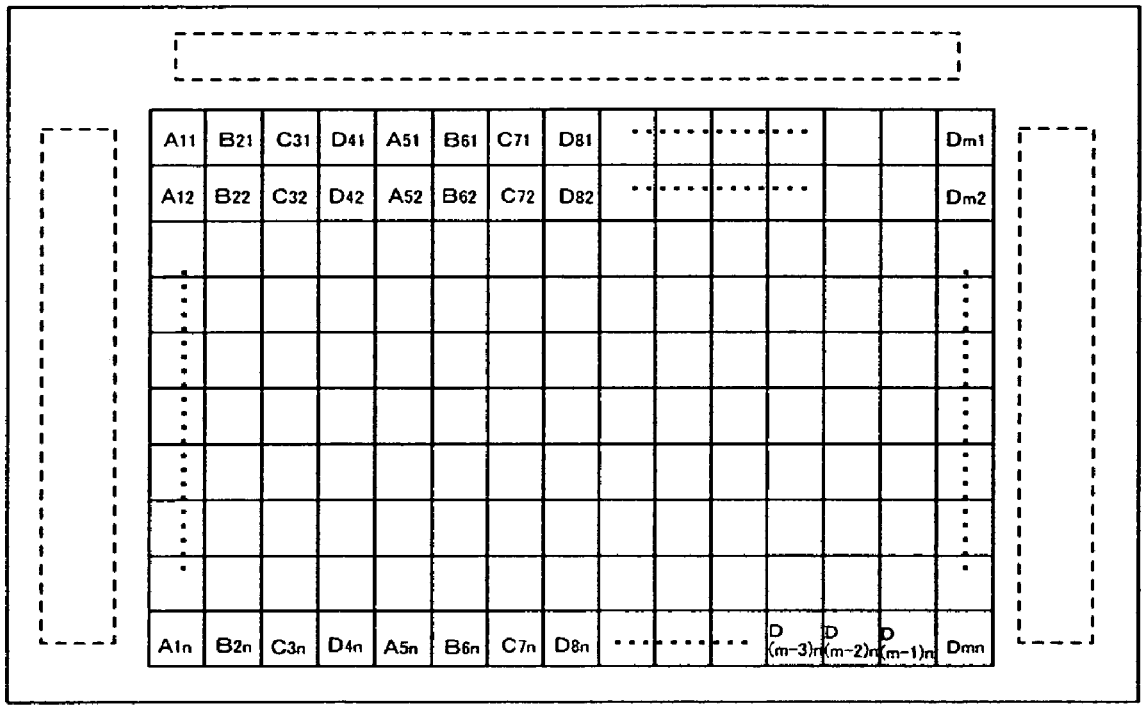
FIG. 14 is a schematic diagram showing addresses of pixels in a pixel portion in accordance with Embodiment Mode 1.
Figure 15:
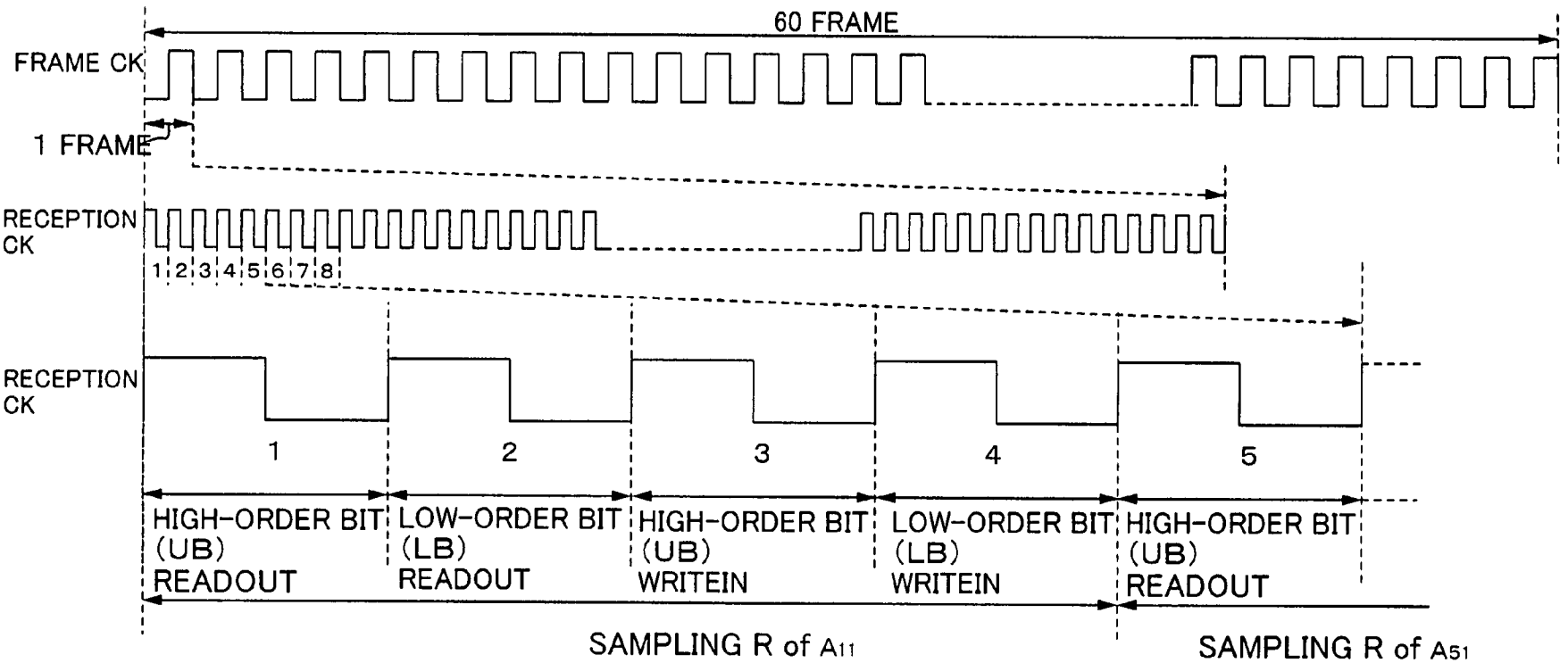
FIG. 15 is a timing chart in accordance with Embodiment Mode 1.
Figure 16:
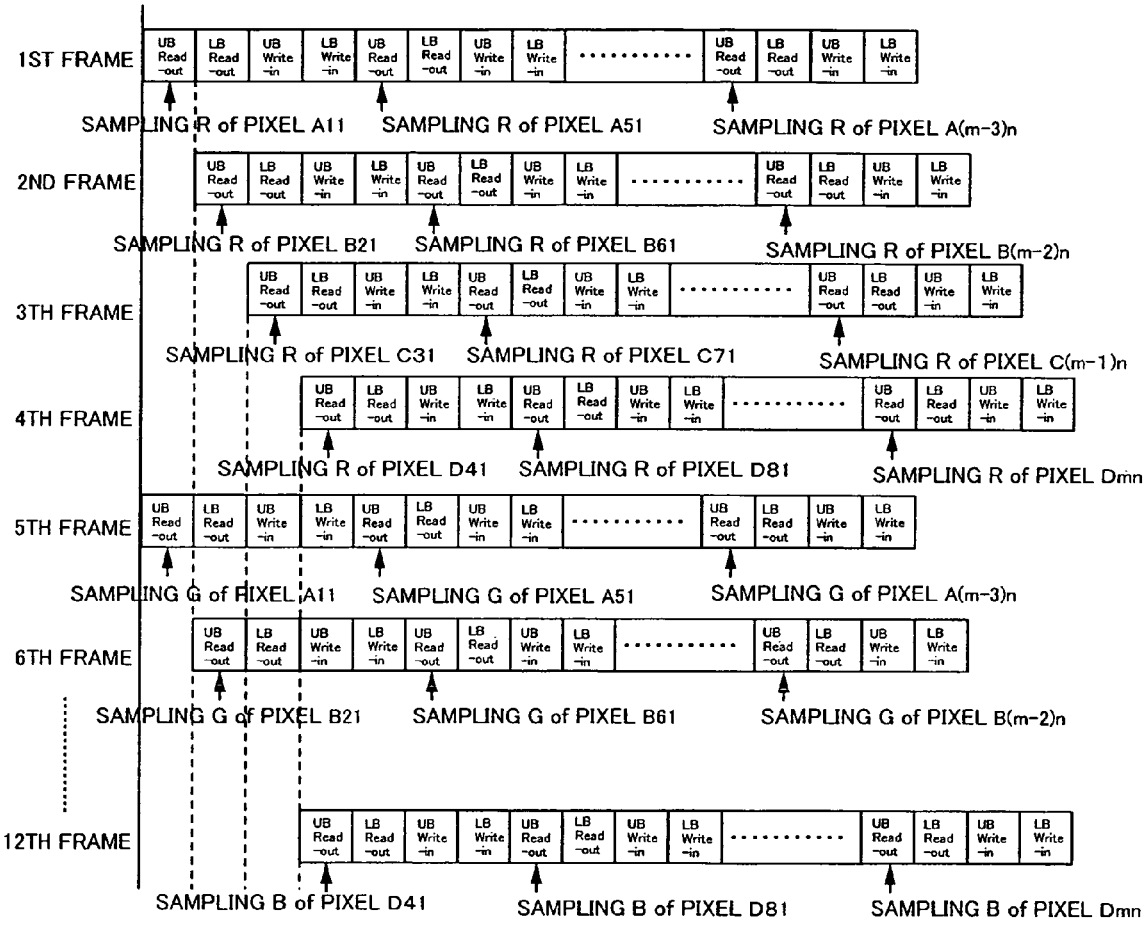
FIG. 16 is a diagram showing the sampling in each frame clock in accordance with Embodiment Mode 1.

Description is made with reference to FIGS. 14 to 16 on the sampling of the light-emission time cumulative data in accordance with each frame clock cycle. Here, description is made using a display portion shown in FIG. 14 which has pixels assigned with addresses: $A_{11}$, $B_{21}$, $C_{31}$, $D_{41}$, $A_{51}$, . . . $A_{(m-3)n}$, $B_{(m-2)n}$, $C_{(m-1)n}$ and $D_{mn}$ in this order from the upper left.

FIG. 15 shows an enlarged chart showing each cycle of a frame clock, and a reception clock. Here, the frame clock has 60 frames a second as set forth above. The number of video data signal receptions of the reception CK in one cycle of this frame clock, namely one frame period $T_f$ is m×n.

Note that one frame period here corresponds to a period in which video data signals for the pixels of $A_{11}$ to $D_{mn}$ shown in FIG. 14 are received. In addition, the reception clock (also referred to as a reception CK) corresponds to a signal having one cycle of $T_f/(m\times2)$ which is obtained by dividing the $T_f$ by the number of video data signal receptions m×n. In addition, a frame clock (also referred to as a frame CK) corresponds to a signal having one cycle of one frame period.

FIG. 16 shows the pixel data sampled in each frame of a frame clock, which is to be referred along with FIGS. 14 and 15. Assuming that sampling of the pixel $A_{11}$ is started in the first frame of a frame clock, 1 to 4 cycles of a reception clock are required for the readout operation of the high-order bit, the readout operation of the low-order bit, the write-in operation of the high-order bit and the write-in operation of the low-order bit as shown in FIG. 15, thus the pixel data which is sampled next is $A_{51}$. Similarly, in the second frame as the next frame clock, sampling is performed in order from the pixel $B_{21}$. Hereinafter, as shown in FIG. 16, sampling is performed in order from the pixel $C_{31}$ in the third frame, and in the fourth frame of the next frame clock, sampling is performed in order from the pixel $D_{41}$. Note that the sampling is performed separately for each color since a different element is used for each color. Therefore, in the aforementioned first to fourth frames, for example, sampling on R is performed to the whole pixels. Here, an example where an image is displayed with the three primary colors of RGB is shown, and in order to sample each RGB of the whole pixels separately, 12 frames of frame clocks are required.

By providing a video data correction circuit having the configuration of this embodiment mode, a margin for access timing can be secured by reducing the number of memory readout accesses in one frame of a reception clock; therefore, the downsizing, lower power consumption and lower cost of a product can be achieved without increasing the capacity or the operation speed of memories.

Further, by storing the cumulative time data by regularly sampling the light-emission time of a light-emitting element, and correcting the video data by referring to the prestored data on changes with time of the light-emitting element as required, corrected video data can be supplied which is capable of controlling the luminance of a degraded light-emitting element to be at substantially an equal level to that of a light-emitting element which has not degraded, while uniform screen display can be maintained in a display device without causing luminance unevenness.

Note that in the case where gray scale display using EL elements is also performed by controlling the luminance thereof, it is desirable to determine the degradation state of the EL elements based on both the light-emission time and intensity by detecting the light-emission intensity of the EL elements as well as the light-emission time thereof. In this case, data for correction is produced correspondingly, and data on the cumulative light-emission time and intensity is stored in the RG volatile memory unit 103A and the B volatile memory unit 103B as well as a degradation correction coefficient based on the cumulative light-emission frequency data which is obtained by sampling the cumulative light-emission time and intensity is prestored in the non-volatile memory unit to the multiplier.

The sampling may be appropriately performed not only in the case where the video data has data on the three primary colors of RGB but also the case where light-emitting elements of another color are additionally provided in pixels of the display device so that images are displayed with four or more colors. For example, in the case where display is performed with four colors (RGB and W (White)), an RG volatile memory unit or a BW volatile memory unit may be provided to perform sampling in the order of R→G→B→W, and the cumulative light-emission frequency data on each color may be outputted from the RG volatile memory unit or the BW volatile memory unit.

As an element used for the memories such as the RG volatile memory unit 103A and the B volatile memory unit 103B, a static memory (SRAM) or a dynamic memory (DRAM) may be used. As an element used for the memory such as the non-volatile memory unit 107, a ferroelectric memory (FeRAM), an EEPROM, a flash memory or the like may be used. However, the invention is not limited to these, and commonly used memory elements may be employed as well. In the case of using a DRAM for the volatile memory unit, however, a regular refresh function is additionally required.

Embodiment Mode 2

Figure 4:
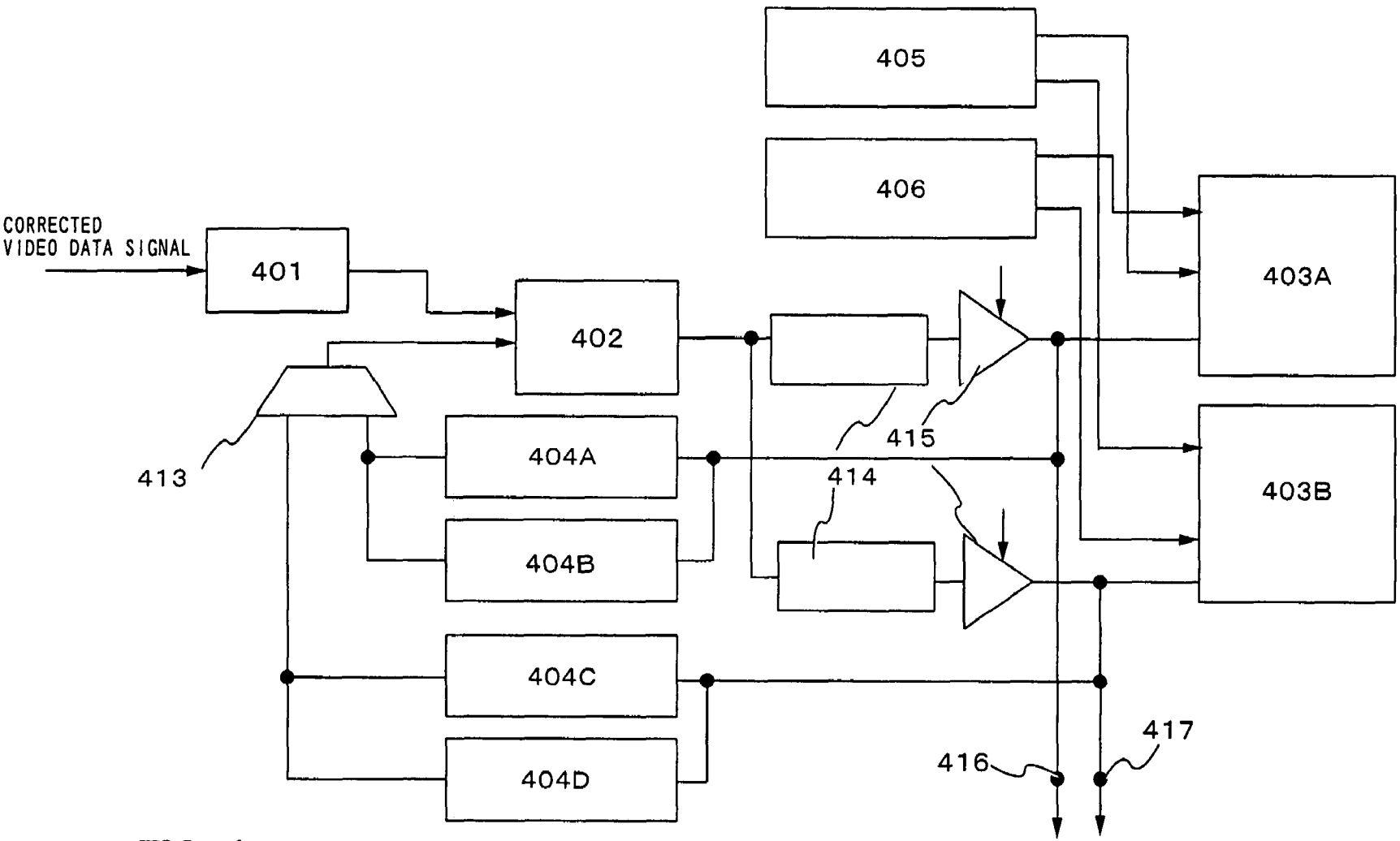
FIG. 4 is a block diagram showing a configuration example of a light-emission time accumulator in accordance with Embodiment Mode 2.

FIG. 4 is a schematic diagram showing a configuration example of a light-emission time accumulator of a video data correction circuit of this embodiment mode. This light-emission time accumulator includes a latch circuit 401 for holding video data to be sampled, an adder 402 for generating new cumulative time data by adding the light-emission time predicted from the sampled video data to the previously stored cumulative time data, and first and second display area volatile memory units 403A and 403B for storing the cumulative time data. Although a volatile memory is exemplarily used for each of the first and second display area volatile memory units, a memory unit using a non-volatile memory may be used for one or both of them. Further, more memory units may be provided. Note that the video data inputted to the latch circuit 401 corresponds to the corrected video data to be actually outputted to the display portion.

In the light-emission time cumulative unit, a volatile memory unit address generating circuit 405 and a volatile memory unit control circuit 406 are provided as a controller of both the first display area volatile memory unit 403A and the second display area volatile memory unit 403B. Further, the adder 402 is provided with a high-order-bit storage register 404A for the first display area and a low-order-bit storage register 404B for the first display area for reading out the cumulative time data from the first display area volatile memory unit 403A to be added to the sampled video data and temporarily storing it, and a high-order-bit storage register 404C for the second display area and a low-order-bit storage register 404D for the second display area for reading out the cumulative time data from the second display area volatile memory unit 403B to be added to the sampled video data and temporarily storing it. In addition, a selector 413 is provided for sequentially switching the cumulative time data on the first display area or the second display area to be inputted to the adder 402. Further, in order to control the timing of writing the cumulative time data which is added by the adder 402 into the first display area volatile memory unit 403A and the second display area volatile memory unit 403B, registers 414 and tri-state buffers 415 are provided. Although a register is used as the memory unit for storing the cumulative time data, the invention is not limited to this and an alternative memory unit may be provided so long as the cumulative time data can be temporarily stored therein.

In this embodiment mode, a display device to be supplied with video data has a plurality of pixels each of which includes an R (Red), G (Green) or B (Blue) light-emitting element, and images are displayed by utilizing the light emission of each RGB light-emitting element in each pixel. In addition, in this embodiment mode, a display device to be supplied with video data has a first display area and a second display area. The first display area is used as an area where odd-numbered video data inputted to the display device is displayed (Odd Video Data Area; OVDA) while the second display area is used as an area where the even-numbered video data inputted to the display device is displayed (Even Video Data Area: EVDA).

In the video data correction circuit of this embodiment mode, the first display area volatile memory unit 403A and the second display area volatile memory unit 403B as the volatile memory units used for accumulating the light-emission time of pixels are assigned with video data on the light-emitting elements of the pixels in the first display area and the video data on the light-emitting elements of the pixels in the second display area respectively, thereby storing the cumulative time data. Note that in this embodiment mode, the cumulative time data is divided into an upper bit and a lower bit, and the upper bit and the lower bit of the video data on light-emitting elements of the pixels in the first display area are stored in the first display area volatile memory unit 403A while the upper bit and the lower bit of video data on light-emitting elements of the pixels in the second display area are stored in the second display area volatile memory unit 403B. Note that the display device supplied with video data is not limited to the one having the first display area and the second display area, and the invention can also be applied to the case where a third display area is provided, in which case the video data may be stored in each of the aforementioned volatile memory units or an another corresponding memory unit may be provided.

Figure 5:
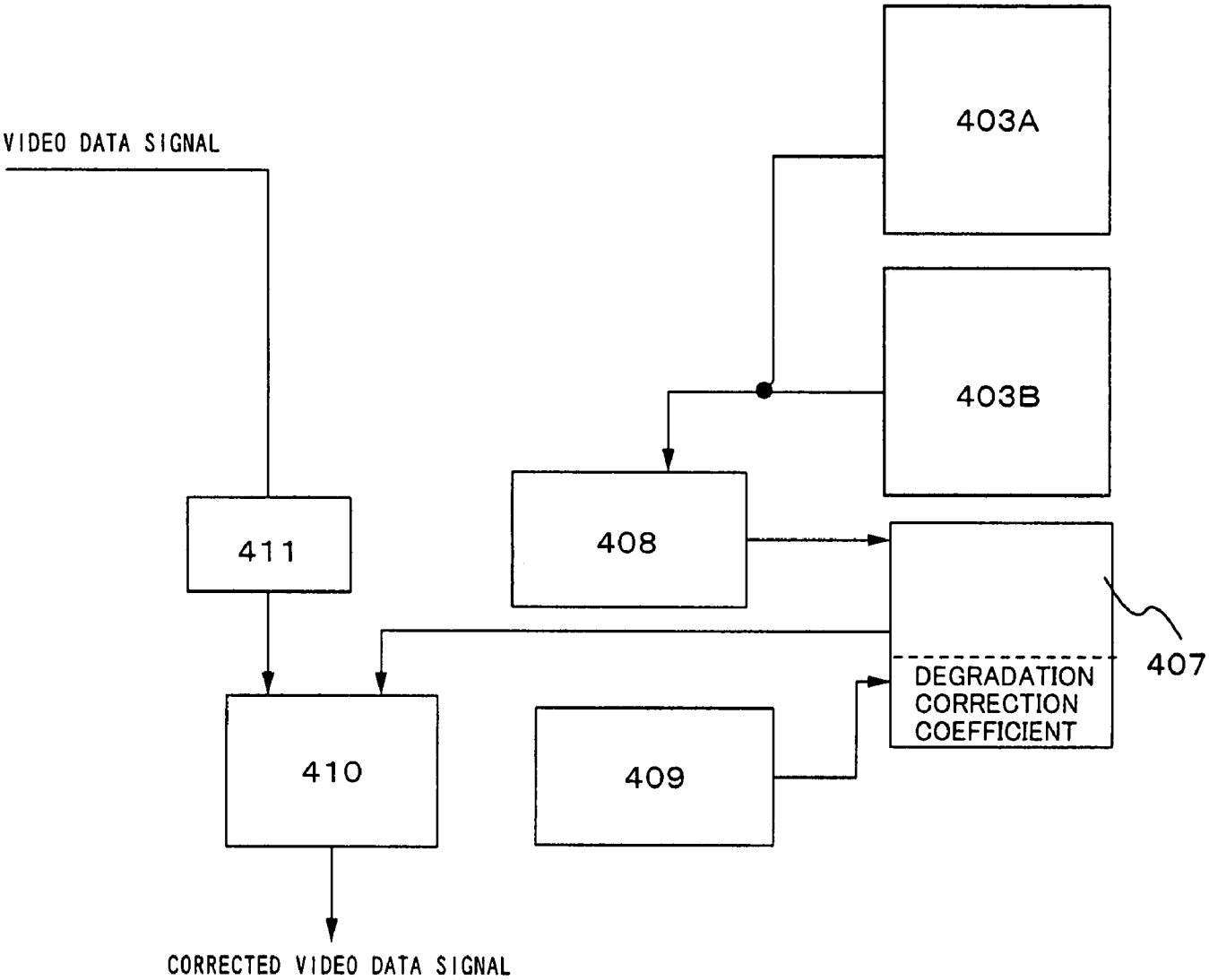
FIG. 5 is a block diagram showing a configuration example of a video data correction unit in accordance with Embodiment Mode 2.

FIG. 5 is a schematic diagram showing a configuration example of a video data correction unit of the video data correction circuit of the invention. The video data correction unit stores degradation correction coefficients, and provided with a non-volatile memory unit 407 as a non-volatile memory unit for backing up the content of the first display area volatile memory unit and the second display area volatile memory unit when the power is off, and a multiplier 410 for generating corrected video data by multiplying pre-correction video data by a degradation correction coefficient corresponding to the cumulative light-emission time of each pixel. In addition, as a controller of the non-volatile memory unit 407, a non-volatile memory unit address generating circuit 408 and a non-volatile memory unit control circuit 409 are provided, each of which controls the non-volatile memory unit 407 by using an address bus and a memory control signal. Note that a delay circuit 411 may be provided when multiplying the pre-correction video data by a degradation correction coefficient in the multiplier 410, thereby video data input can be synchronized with the output of a degradation correction coefficient.

Description is made on the operation of the aforementioned video data correction circuit. First, data on changes with time of the luminance characteristics of a light-emitting element of a display device typified by an EL element is prestored in the non-volatile memory unit 407 as a degradation correction coefficient for correcting video data in accordance with the degree of degradation so as to eliminate the influence of the degradation. As an alternative configuration, another circuit unit for prestoring a degradation correction coefficient may be provided, such as a degradation correction coefficient storage register for storing data on changes with time of the luminance characteristics of a light-emitting element of a display device.

Note that in this embodiment mode, the degradation correction coefficient for correcting the luminance of a light-emitting element is calculated by using Formula 2. In Formula 2, t is a light-emission cumulative time, $K_0$ is the ideal luminance, K(t) is the luminance at the light-emission cumulative time t, and a(t) is a degradation correction coefficient at the light-emission cumulative time t.

$$K_0 = a(t) \times K(t). \quad \text{[Formula 2]}$$

Video data (VD) inputted to the video data correction circuit is regularly sampled in the latch circuit 401, and the number of light emissions/non-light emissions in each pixel which is counted based on the video data is sequentially stored in a divided data form into the first display area volatile memory unit 403A and the second display area volatile memory unit 403B. The aforementioned regular sampling is performed once a second in this embodiment mode.

Figure 6:
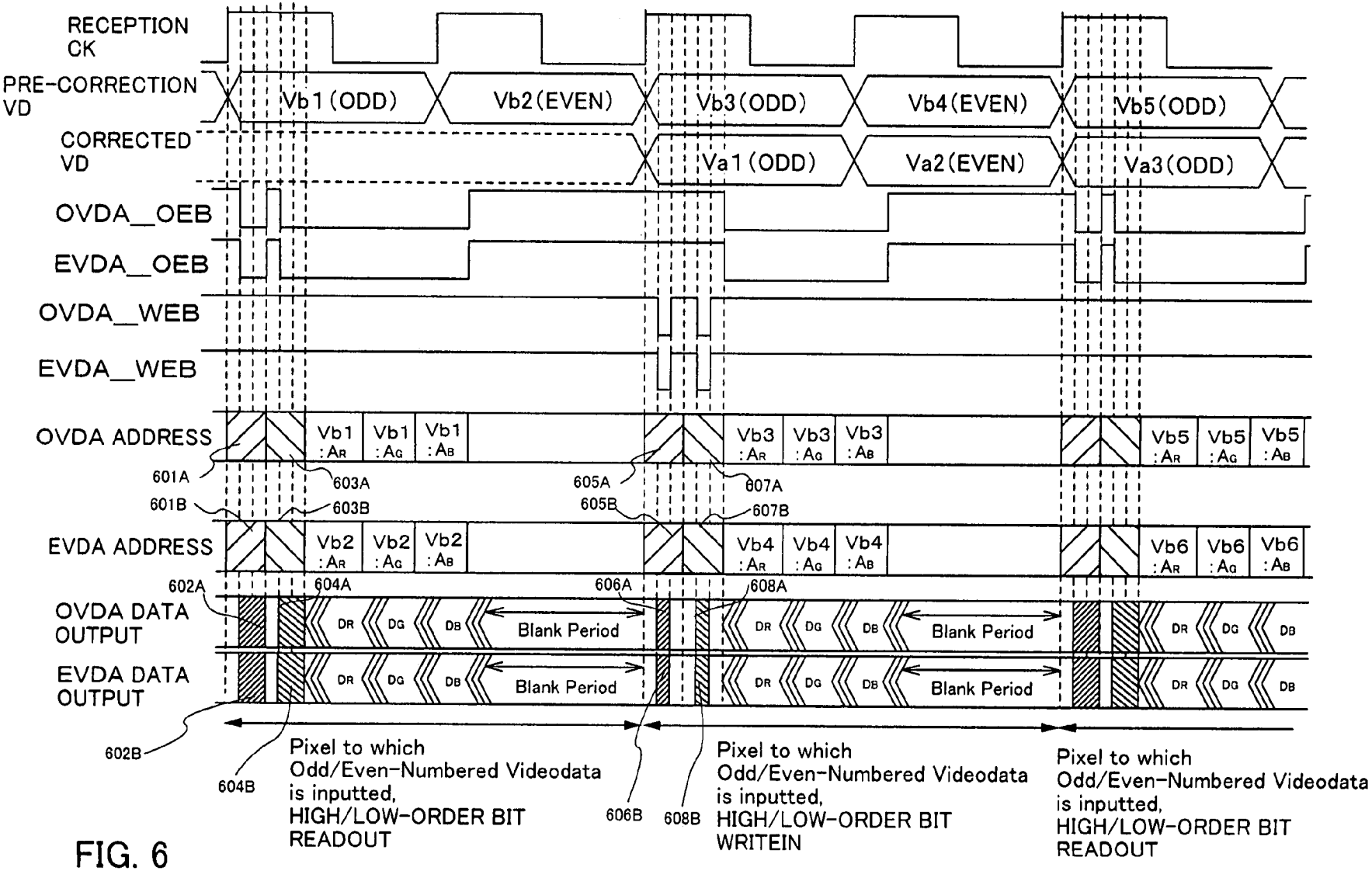
FIG. 6 is a timing chart in accordance with Embodiment Mode 2.

Here, FIG. 6 shows a timing chart of a reception clock (reception CK), a pre-correction video data signal (pre-correction VD: Vb1, Vb2, . . . ) a corrected video data signal (corrected VD: Va1, Va2, . . . ), a readout control signal for an area in which the odd-numbered video data is displayed (OVDA_OEB), a readout control signal for an area in which the even-numbered video data is displayed (EVDA_OEB), a write-in control signal for an area in which the odd-numbered video data is displayed (OVDA_WEB), a write-in control signal for an area in which the even-numbered video data is displayed (EVDA_WEB), a volatile memory unit address for the odd-numbered video data (OVDA address: $A_R$, $A_G$ and $A_B$), a volatile memory unit address for the even-numbered video data (EVDA address: $A_R$, $A_G$ and $A_B$), an output of the light-emission time cumulative data on the odd-numbered video data (OVDA data output: $D_R$, $D_G$ and $D_B$), and an output of the light-emission time cumulative data of the even-numbered video data (EVDA data output:

$D_R$, $D_G$ and $D_B$), which are used in the light-emission time accumulator of the invention.

Description is made briefly on the write-in/readout operation to/from the first display area volatile memory unit 403A or the second display area volatile memory unit 403B. When the OVDA_OEB is at High or Low (Low in this specification), video data can be read out from the first display area volatile memory unit 403A and when the EVDA_OEB is at High or Low (low in this specification), video data can be read out from the second display area volatile memory unit 403B. Meanwhile, when the OVDA_WEB is at High or Low (Low in this specification), video data can be written into the first display area volatile memory unit 403A and when the EVDA_WEB is at High or Low (Low in this specification), video data can be written into the second display area volatile memory unit 403B. As shown in FIG. 6, the high-order-bit time cumulative data on R of the first display area is read out form the first display area volatile memory unit 403A in the period when the OVDA address is specified and the OVDA_OEB is at Low.

Although the sampling of each color of pixels is carried in the order of R→G→B in this embodiment mode, it is needless to mention that the invention is not limited to this sampling order, and the sampling may be performed by appropriately changing the order. For example, it may be G→R→B or other orders.

The sampling of a pre-correction VD is described with reference FIGS. 4 to 6 with time. In the first and second cycles of a reception cycle, the OVDA_OEB and the EVDA_OEB are set Low in order to read out the high-order-bit time cumulative data on a pixel to which the odd-numbered video data is inputted and a pixel to which the even-numbered video data is inputted, each having a predetermined color (R in this embodiment mode) of a pre-correction VD. In synchronization with this, high-order-bit time cumulative readout addresses 601A and 601B are specified in the OVDA address and the EVDA address respectively while high-order-bit time cumulative readout data 602A on the pixel to which the odd-numbered video data on R is inputted and high-order-bit time cumulative readout data 602B on the pixel to which the even-numbered video data on R is inputted are stored in the first display area high-order-bit storage register 404A and the second display area high-order-bit storage register 404C respectively.

Subsequently, in order to read out the low-order-bit time cumulative data on the pixels to which the odd-numbered video data the even-numbered video data on a predetermined color (R in this embodiment mode) of a pre-correction VD1 are inputted, the OVDA_OEB and the EVDA_OEB are set Low again. In synchronization with this, a low-order-bit time cumulative readout address 603A and a low-order-bit time cumulative readout address 603B are specified in the OVDA address and the EVDA address respectively while low-order-bit time cumulative readout data 604A on the pixel to which the odd-numbered video data on R and low-order-bit time cumulative readout data 604B on the pixel to which the even-numbered video data on R are stored in the first display area high-order-bit storage register 404B and the second display area high-order-bit storage register 404D respectively.

Then, in the third and fourth cycles of the reception clock, the high-order-bit time cumulative readout data 602A and 602B on the pixels to which the odd-numbered video data and the even-numbered video data on a predetermined color (R in this embodiment mode) of a pre-correction VD1 are inputted, which are stored in the first display area high-order-bit storage register 404A and the second display area high-order-bit storage register 404C respectively, are outputted to the adder so that the high-order-bit time cumulative data on R inputted to the adder is synchronously added to the high-order-bit time cumulative data on R of the Vb1 with a latch or the like (not shown). The added high-order-bit time cumulative write-in data 606A and 606B on the pixel to which the odd-numbered video data on R is inputted and the pixel to which the even-numbered video data on R is inputted are once stored in the registers 414, and in order to write these into the first display area volatile memory unit 403A and the second display area volatile memory unit 403B, a high-order-bit time cumulative readout address 605A and a high-order-bit time cumulative readout address 605B are specified in the OVDA address and the EVDA address respectively, and in synchronization with this, the OVDA_WEB and the EVDA_WEB are set Low.

Then, the low-order-bit time cumulative readout data 604A and 604B on the pixels to which the odd-numbered video data and the even-numbered video data on a predetermined color (R in this embodiment mode) of a pre-correction VD1 are inputted, which are stored in the first display area low-order-bit storage register 404B and the second display area low-order-bit storage register 404D respectively, are outputted to the adder 402, which are synchronously added to the low-order-bit time cumulative data on R of the Vb1 with a latch or the like (not shown). The added high-order-bit cumulative write-in data 608A and 608B on the pixels to which the odd-numbered video data on R is inputted and the pixels to which the even-numbered video data on R is inputted are once stored in the registers 414, and in order to write these into the first display area volatile memory unit 403A and the second display area volatile memory unit 403B, a low-order-bit time cumulative write-in address 607A and a low-order-bit time cumulative write-in address 607B are specified in the OVDA address and the EVDA address respectively, and in synchronization with this, the OVDA_WEB and the EVDA_WEB are set Low.

Although the aforementioned readout and write-in operations are performed in the order from the high order bit to the low order bit, the operations may be performed in different orders.

In the aforementioned manner, the light-emission cumulative data on R light-emitting elements of the pixels where the odd-numbered video data and the even-numbered video data are displayed is accumulated in the volatile memory units in parallel using 1 to 4 cycles of a reception clock. In order to sample the B and G light-emitting elements of the pixels to which the odd-numbered video data is inputted and the pixels to which the even-numbered video data is inputted, an operation similar to the R sampling operation may be performed.

The aforementioned sampling of the pre-correction video data is performed to the pixels of the whole colors, and in order to multiply the sampled time cumulative data by a degradation correction coefficient to obtain video data to be inputted to the display portion, high-order-bit time cumulative data on each pixel is outputted from the first display area volatile memory unit 403A and the second display area volatile memory unit 403B to a non-volatile memory unit address generating circuit through a node 416 and a node 417.

Here, description is made on the write-in operation of the high-order-bit time cumulative data on R and the low-order-bit time cumulative data on R into the first display area volatile memory unit in which the high-order-bit time cumulative data on R and low-order-bit time cumulative data on R are written into the first display area volatile memory unit and the high-order-bit time cumulative data is outputted from the first display area volatile memory unit to the multiplier of the high-order-bit time cumulative data. In addition, description is made on the write-in operation of the high-order-bit time cumulative data on R and the low-order-bit time cumulative data on R into the second display area volatile memory unit in which the high-order-bit time cumulative data on R is written into the second display area volatile memory unit and the high-order-bit time cumulative data is outputted from the second display area volatile memory unit to the multiplier of the high-order-bit time cumulative data.

By separately providing the first display area volatile memory unit and the second display area volatile memory unit, the high-order-bit time cumulative data on R of the first display area and the high-order-bit time cumulative data on R of the second display area can be simultaneously outputted to the video data correction unit from the first display area volatile memory unit and the second display area volatile memory unit respectively. In addition, the remaining data on G may be appropriately outputted after outputting the light-emission period cumulative data on R as shown in FIG. 6. Accordingly, a blank period is secured as shown in FIG. 6 as compared to the conventional access timing.

Figure 7:
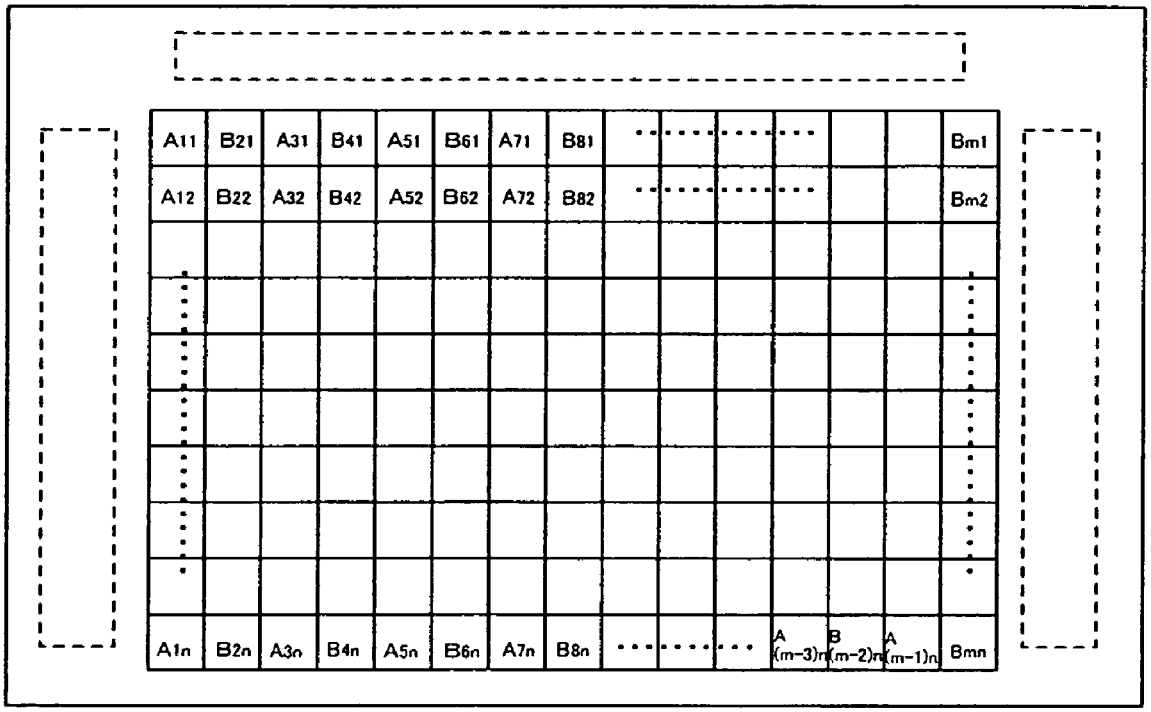
FIG. 7 is a schematic diagram showing addresses of pixels in a pixel portion in accordance with Embodiment Mode 2.
Figure 8:
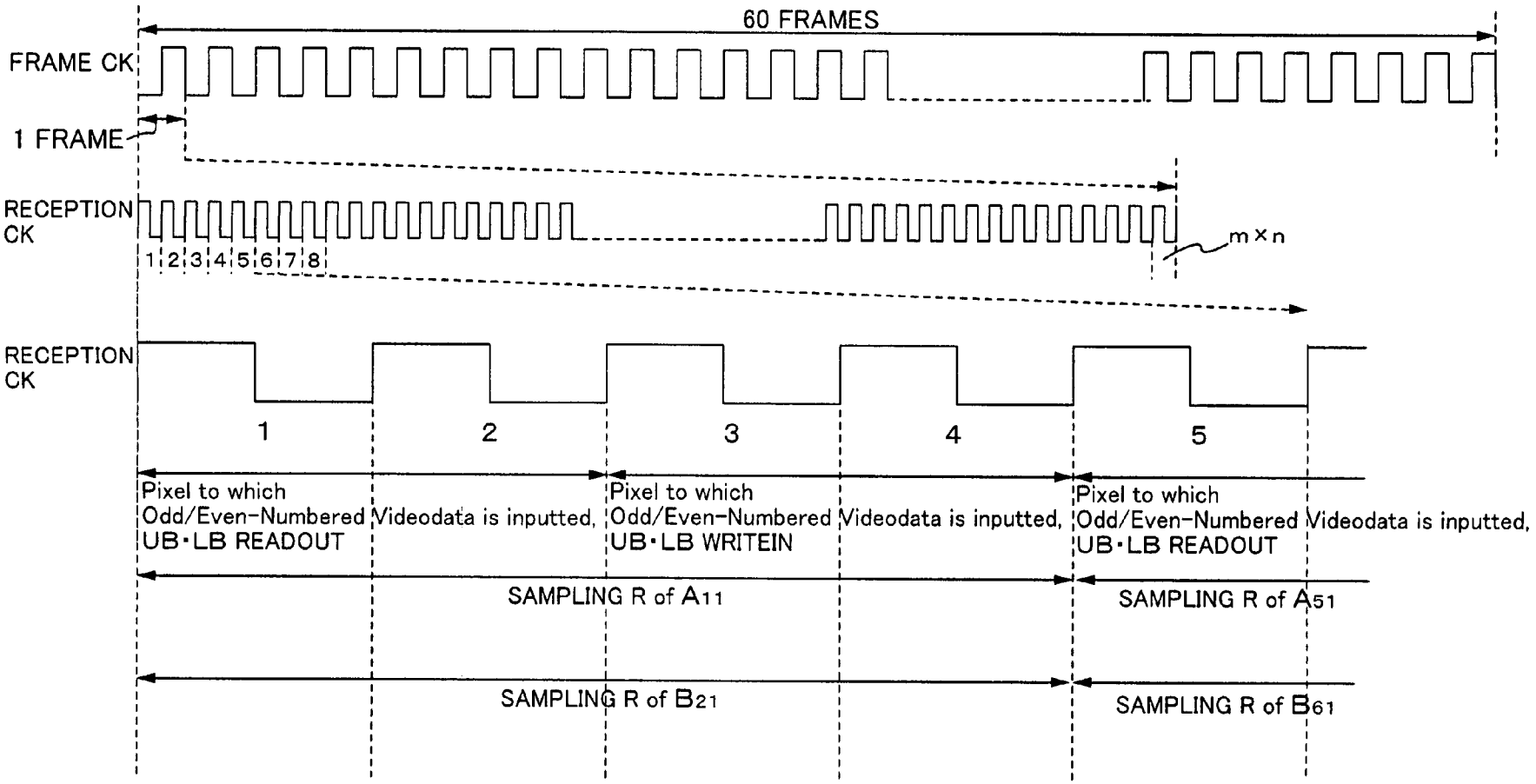
FIG. 8 is a timing chart in accordance with Embodiment Mode 2.
Figure 9:
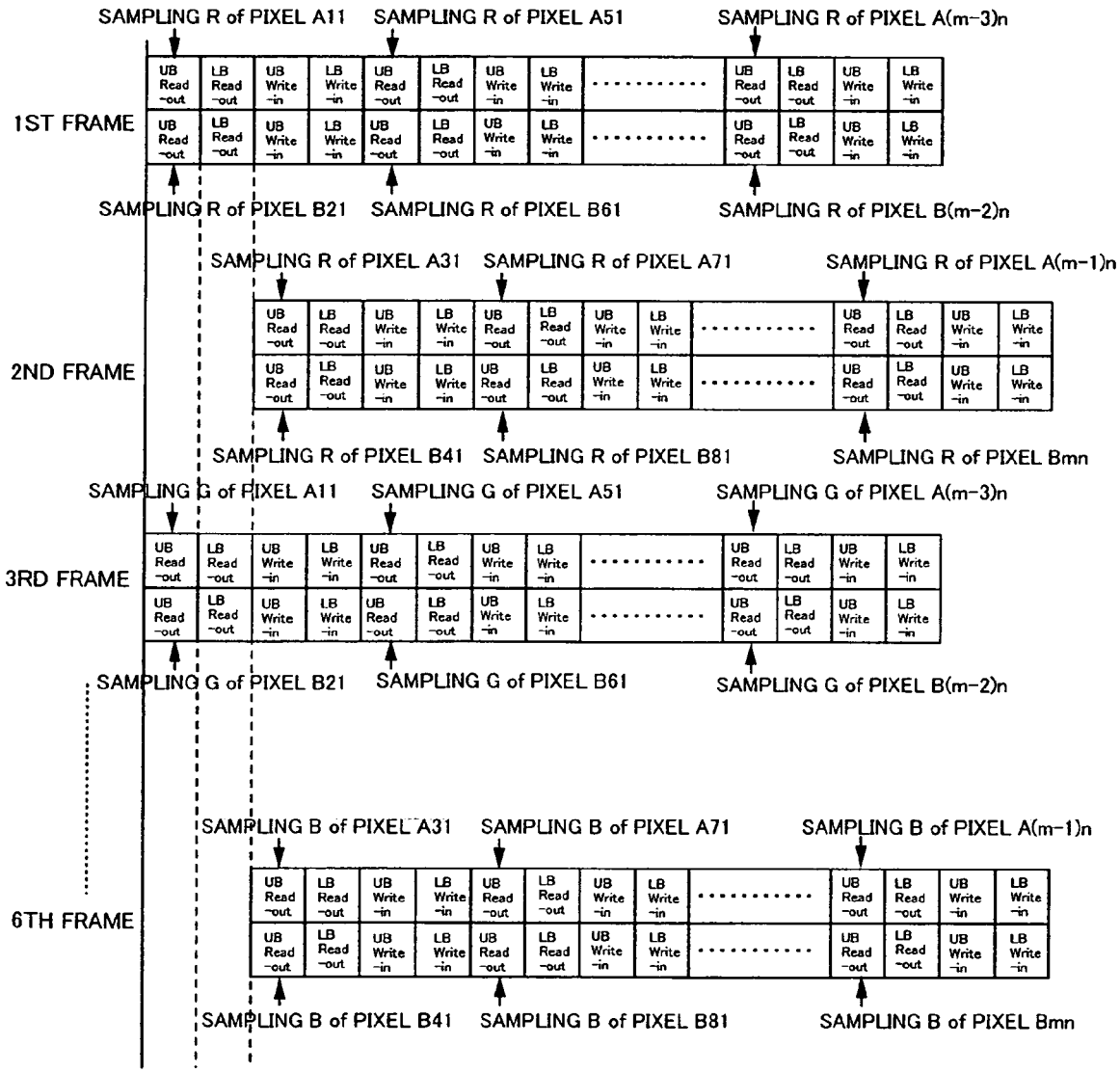
FIG. 9 is a diagram showing the sampling in each frame clock in accordance with Embodiment Mode 2.

Description is made with reference to FIGS. 7 to 9 in further details. Here, description is made using a display portion shown in FIG. 14 which has pixels assigned with addresses: $A_{11}$, $B_{21}$, $A_{31}$, $B_{41}$, $A_{51}$, . . . $A_{(m-3)n}$, $B_{(m-2)n}$, $A_{(m-1)n}$ and $B_{mn}$ in this order from the upper left.

FIG. 8 shows an enlarged chart showing each cycle of a frame clock (hereinafter, frame CK) and a reception clock (hereinafter, reception CK). Here, the frame clock has 60 frames a second as set forth above. The number of video data signal receptions of the reception CK in one cycle of this frame clock, namely one frame period $T_f$ is m×n.

Note that one frame period here corresponds to a period in which video data signals for the pixels $A_{11}$ to $D_{mn}$ shown in FIG. 7 are received. In addition, the reception clock (also referred to as a reception CK) corresponds to a signal having one cycle of $T_f/(m\times n)$ which is obtained by dividing the $T_f$ by the number of video data signal receptions: m×n. In addition, a frame clock (also referred to as a frame CK) corresponds to a signal having one cycle of one frame period.

FIG. 9 shows the pixel data sampled in each frame of the frame CK, which is referred to along with FIGS. 7 and 8. In the first frame of the frame CK, assuming that sampling is started from the pixels $A_{11}$ and $B_{21}$, 1 to 4 cycles of a reception clock are required for the readout operation from the first and second display area volatile memory units (for example, the readout operation of the pixels $A_{11}$ and $B_{21}$), the write-in operation into the first and second display area volatile memory units (for example, the write-in operation of the pixels $A_{11}$ and $B_{21}$), thus the pixel data sampled next corresponds to $A_{51}$ and $B_{61}$. Similarly, in the second frame of a frame clock, sampling is performed in order from the pixels $A_{31}$ and $B_{41}$. Note that the sampling is separately performed for each color since a different element is used for each color. Here, an example in which an image is displayed using the three primary colors of RGB is shown, in which each color of RGB is sampled separately, and in the aforementioned first to second frames, the whole R pixels are sampled. Therefore, in order to sample the whole RGB pixels, 6 frames of a frame CK are required. Thus, sampling can be performed more efficiently as compared to Embodiment Mode 1 where 12 frames of a frame CK are required.

As set forth above, by storing the cumulative time data by regularly sampling the light-emission period of a light-emitting element, and correcting the video data by referring to the prestored data on changes with time of the light-emitting element as required, corrected video data can be supplied which is capable of controlling the luminance of a degraded light-emitting element to be at substantially an equal level to that of a light-emitting element which has not degraded, while uniform screen display can be maintained in a display device without causing luminance unevenness.

Note that in the case where gray scale display using EL elements is also performed by controlling the luminance thereof, it is desirable to determine the degradation state of the EL elements based on both the light-emission time and intensity by detecting the light-emission intensity of the EL elements as well as the light-emission time thereof. In this case, data for correction is produced correspondingly, and data on the cumulative light-emission time and intensity is stored in the first display area volatile memory unit 403A and the second display area volatile memory unit 403B as well as a degradation correction coefficient based on the cumulative light-emission frequency data which is obtained by sampling the cumulative light-emission time and intensity is prestored in the non-volatile memory unit.

The sampling may be appropriately performed not only in the case where the video data has data on the three primary colors of RGB but also the case where light-emitting elements of another color are additionally provided in pixels of the display device so that images are displayed with four or more colors. For example, in the case where display is performed with four colors (RGB and W (White)), an RG volatile memory unit or a BW volatile memory unit may be provided to perform sampling in the order of R→G→B→W, and the cumulative light-emission frequency data on each color may be outputted from the first display area volatile memory unit or the second display area volatile memory unit to the multiplier.

As an element used for the memories such as the first display area volatile memory unit 403A and the second display area volatile memory unit 403B, a static memory (SRAM) or a dynamic memory (DRAM) may be used. As an element used for the memory such as the non-volatile memory unit 407, a ferroelectric memory (FeRAM), an EEPROM, a flash memory or the like may be used. However, the invention is not limited to these, and commonly used memory elements may be employed as well. In the case of using a DRAM for the volatile memory unit, however, a regular refresh function is additionally required.

As set forth above, by dividing the cumulative time data into an upper bit and a lower bit, and assigning each data fragment with a memory unit for storing the cumulative time data for accumulation, the capacity of a memory used as a volatile memory is not required to be increased, thereby the number of connection pins is reduced as well as the area of the circuits can be reduced, which leads to the lower manufacturing cost and the downsizing of the device.

Embodiment Mode 1

The video data correction circuit of the invention is separately provided outside the display portion, thereby video data signals inputted to the display portion can be corrected. Alternatively, as shown in FIG. 10, the video data correction circuit of the invention can be formed over the same substrate as the display portion.

Figure 10:
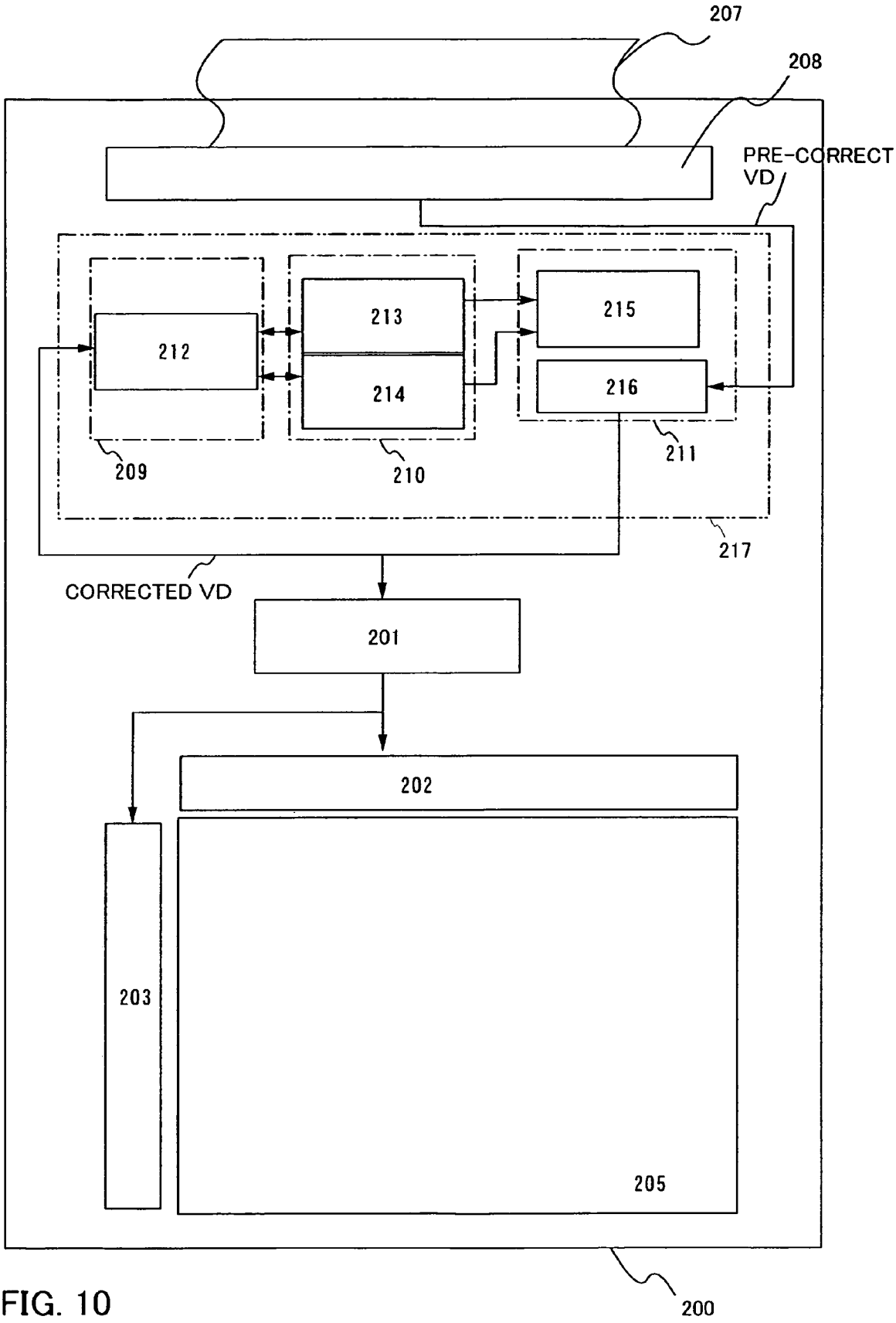
FIG. 10 is a schematic diagram showing a display device incorporating the video data correction circuit of the invention in accordance with Embodiment 1.

In the display device shown in FIG. 10, a format converting unit 201, a source signal line driver circuit 202, a gate signal line driver circuit 203, a pixel portion 205, a video data correction circuit 206 and a connector 208 are formed over a common substrate 200, to which video data is inputted through a flexible printed circuit (FPC) board 207 connected to the connector 208. The aforementioned flexible printed board 207 may be an anisotropic conductive film (ACF). As the video data correction circuit 206, the video data correction circuit of the invention can be used which has an adder unit 209 including an adder 212, a memory unit 210 including a first volatile memory unit 213 and a second volatile memory unit 214, and a correction unit 211 including a volatile memory unit 215 and an adder 216. As the substrate 200, a glass substrate may be preferably used. However, in stead of the glass substrate, another substrate such as a heat-resistant plastic substrate may be used. Each of the source signal line driver circuit 202 and the gate signal line driver circuit 203 may be a known circuit, and depending on the circuit configuration, a plurality of gate signal line driver circuits may be provided.

According to the invention, in the readout operation of a high-order bit of the light-emission cumulative time data from the volatile memory unit in each frame of a reception clock for storing the light-emission cumulative time data in volatile memory units by counting the light-emission time of light-emitting elements, a margin for access timing can be secured by reducing the number of memory readout accesses in one frame of a reception clock; therefore, the capacity or the operation speed of memories is not required to be increased. Thus, the invention realizes the downsizing, lower power consumption and lower cost of a product. Further, in the case where a video data correction circuit is formed over the same substrate as a display portion, an area occupied by a video data correction circuit per se can be reduced, thereby a narrower frame can be achieved.

In addition, according to the invention, and in the operation for reading out a high-order bit of the light-emission cumulative time data from volatile memories in each frame of a reception cycle for storing the light-emission cumulative time data in the volatile memories by counting the light-emission time of light-emitting elements, the cumulative time data on a pixel to which the odd-numbered video data is inputted and the cumulative time data on a pixel to which the even-numbered video data is inputted are simultaneously read out from two volatile memories. Thus, a margin for access timing can be secured by reducing the number of readout accesses to memories in one frame of a reception clock in this operation. Therefore, the capacity and the operation speed of memories are not required to be increased. Further, since the light-emission time of a pixel to which the odd-numbered video data is inputted and a pixel to which the even-numbered video data is inputted can be performed in parallel in one frame of a frame clock, the number of memory accesses can be drastically reduced. Thus, the invention can contribute to the downsizing, lower power consumption and lower cost of a product.

Embodiment Mode 2

Figure 11A:
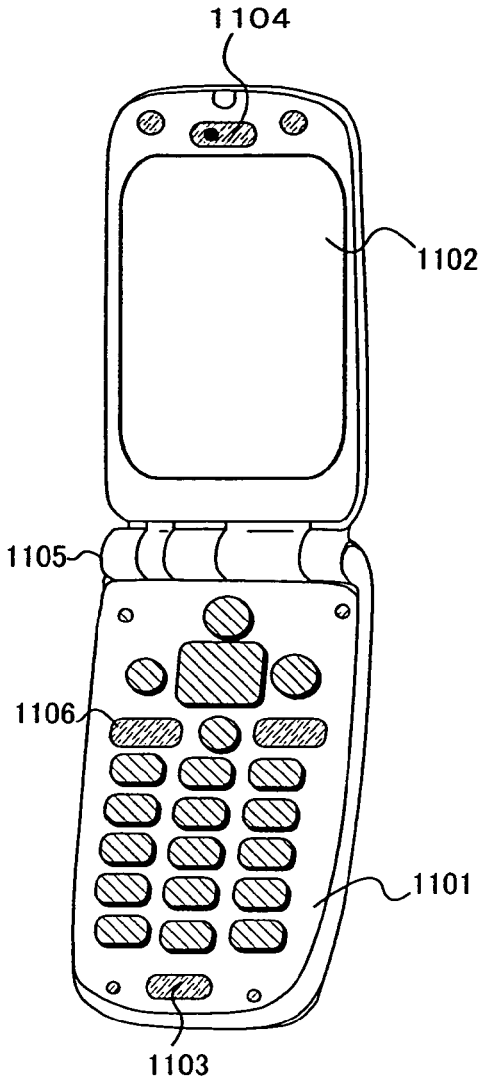
FIGS. 11A to 11C are electronic appliances each incorporating the video data correction circuit of the invention in accordance with Embodiment 2.

In this embodiment, description is made on electronic appliances each having a display device to which the invention in accordance with the Embodiment 1 is applied. The electronic appliances include a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device (e.g., a car audio or an audio-component stereo), a game machine provided with a display device, a portable information terminal (e.g., a mobile computer, a quickcast, a portable game machine or an electronic book), an image reproducing device provided with a recording medium (specifically, a device for reproducing video or still images recorded in a recording medium such as a Digital Versatile Disc (DVD) and having a display portion for displaying the reproduced image) or the like. FIGS. 11A and 11B show specific examples of such electronic appliances.

Description is made on examples where a display device using the invention is applied to an information terminal such as a folding portable phone or a PDA. FIG. 11A is a perspective view of a folding portable phone. The portable phone shown in FIG. 11A includes a main body 1101, a first display portion 1102, an audio input portion 1103, an audio output portion 1104, a hinge 1105, an operating key 1106 and the like. The portable phone shown in FIG. 11A can be folded with the hinge 1104 though shown herein is in an unfolded state.

The invention can be applied to a video data correction circuit as a peripheral circuit of the first display portion 1102. As a result, even in the case where degradation is caused in an element inside the display screen of the self-luminous device, normal image display without luminance unevenness can be performed as well as the downsizing of a display portion, the downsizing of the whole device or a narrower frame and the lower manufacturing cost can be facilitated.

The portable phone shown in this embodiment may have a built-in digital camera.

The portable phone shown in FIG. 11(A) can be folded with the hinge 1105. FIG. 11B shows the portable phone in a folded state. The folded portable phone 1107 includes a second display portion 1108, a speaker portion 1109, an operating key 1110 and the like. With this shape, a user can recognize data while viewing the second display portion 1108.

A display device using the invention can be effectively applied to the second display portion as well. In the case where a plurality of display portions are provided, advantageous effects of the invention can be increased such that the downsizing of a display portion, the downsizing of the whole device or a narrower frame as well as the lower manufacturing cost can be achieved.

In addition, the invention can be effectively applied to the case where another display portion is provided in the portion other than the aforementioned.

Figure 11C:
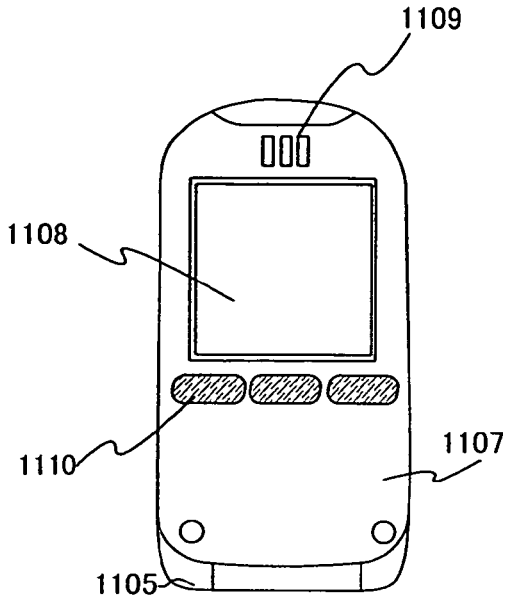
Figure 11B:
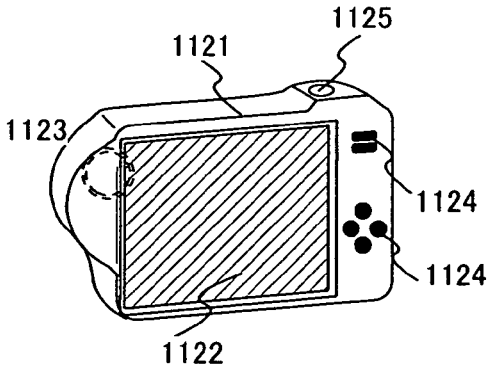

FIG. 11C is a digital still camera which includes a main body 1121, a display portion 1122, an image-receiving portion 1123, an operating key 1124, a shutter 1125 and the like. The digital still camera of this embodiment generates video signals through photoelectric conversion of an optical image of an object with an image pick-up element of a CCD (Charge Coupled Device). The display portion 1122 performs display based on the video signal obtained by the CCD, and the display device functions as a finder for displaying an object. It is needless to mention that the invention can be effectively applied to other image pick-up devices such as a CMOS. The invention can be applied to a peripheral circuit (a video data correction circuit or a control circuit) of the display portion 1122. As a result, even in the case where degradation is caused in an element inside the display screen of the self-luminous device, normal image display without luminance unevenness can be performed as well as the downsizing or a narrower frame of a display portion, the downsizing of the whole device and the lower manufacturing cost can be achieved.

Figure 12A:
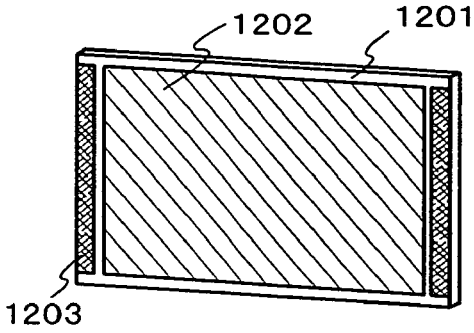
FIGS. 12A to 12D are electronic appliances each incorporating the video data correction circuit of the invention in accordance with Embodiment 2.

FIG. 12A is a desktop, floor-stand or wall-hung type display which includes a housing 1201, a display portion 1202, a speaker portion 1203 and the like. The invention can be applied to a video data correction circuit as a peripheral circuit of the display portion 1202. By applying the invention, normal image display without luminance unevenness can be performed as well as the downsizing or a narrower frame of a display portion, the downsizing of the whole device and the lower manufacturing cost can be achieved even in the case where degradation is caused in an element inside the display screen of the self-luminous device.

Figure 12C:
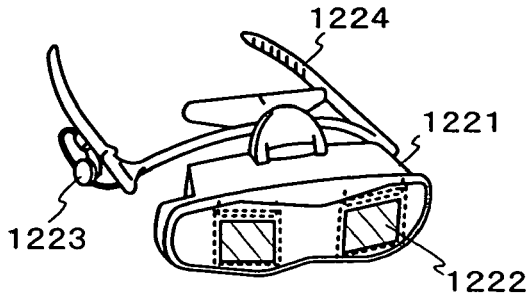
Figure 12B:
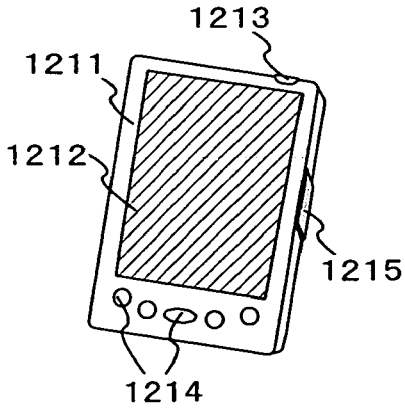

FIG. 12B is a portable information terminal device which includes a main body 1211, a display portion 1212, a switch 1213, operating keys 1214, an IR port 1215 and the like. The display portion 1212 mainly displays image data and text data. The invention can be applied to a peripheral circuit (a video data correction circuit or a control circuit) of the display portion 1212. As a result, even in the case where degradation is caused in an element inside the display screen of the self-luminous device, normal image display without luminance unevenness can be performed as well as the downsizing of a display portion, the downsizing of the whole device and the lower manufacturing cost can be achieved.

FIG. 12C is a goggle display which includes a main body 1221, a display portion 1222, an earphone 1223, a temple frame 1224 and the like. The invention can be applied to a peripheral circuit (a video data correction circuit or control circuit) of the display portion 1222. As a result, even in the case where degradation is caused in an element inside the display screen of the self-luminous device, normal image display without luminance unevenness can be performed as well as the downsizing of a display portion, the downsizing of the whole device and the lower manufacturing cost can be achieved.

Figure 12D:
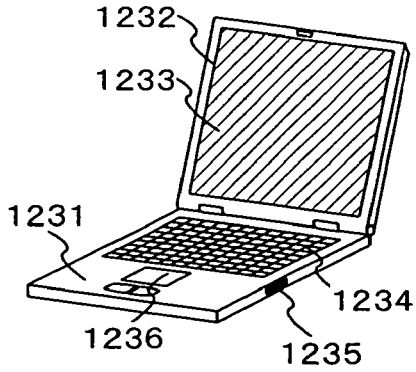
Figure 13:
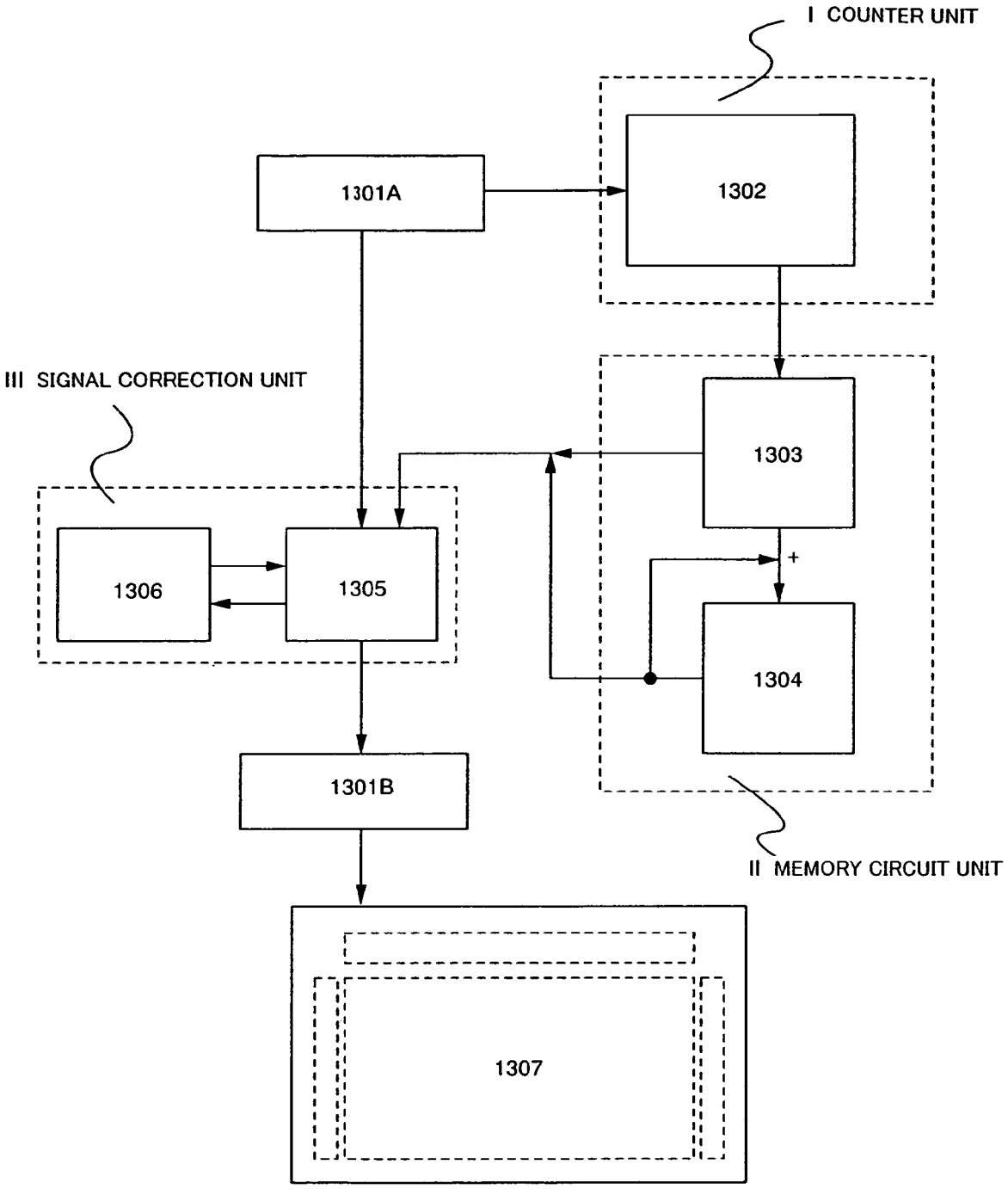
FIG. 13 is a block diagram showing a configuration example of a conventional video data correction circuit.

FIG. 12D is a computer which includes a main body 1231, a housing 1232, a display portion 1233, a key board 1234, an external connection port 1235, a pointing mouse 1236 and the like. The invention can be applied a peripheral circuit (video data correction circuit or a control circuit) of the display portion 1233. As a result, even in the case where degradation is caused in an element inside the display screen of the self-luminous device, normal image display without luminance unevenness can be performed as well as the downsizing of a display portion, the downsizing of the whole device and the lower manufacturing cost can be achieved. Note that the computer includes a so called notebook computer incorporating a central processing-unit (CPU) and a recording medium, and a so-called desktop computer which does not incorporate a CPU and a recording medium or the like.

Note that the electronic appliance to which a display device having the video data correction circuit of the invention is applied includes the portable phone in FIGS. 11A and 11B, the display in FIG. 12A, the portable information terminal in FIG. 12B, the goggle display in FIG. 12C and the computer in FIG. 12D as well as a video recorder of a view finder type and/or a direct view type, a quickcast, an electronic databook, an electronic calculator, a video phone, a POS terminal, a device provided with a touch panel, an electronic book and the like. It is needless to mention that the display device having the aforementioned video data correction circuit can be applied to the display portion of each electronic appliance.

Note that the display device used for such electronic appliances can be formed using a heat-resistant plastic substrate as well as a glass substrate. Accordingly, even more downsizing can be achieved.

The aforementioned embodiments to which the invention is applied are only exemplary ones, and therefore, the invention is not limited to these. It is needless to mention that various changes and modifications will be apparent to those skilled in the art without departing from the technical ingenuity determined by the scope of the invention. For example, the aforementioned embodiments can be implemented by freely combining each embodiment mode and embodiment.

The present application is based on Japanese Priority application No. 2004-315163 filed on Oct. 29, 2004 with the Japanese Patent Office, the entire contents of which are hereby incorporated by reference.

What is claimed is:

1. A display device comprising:

a pixel portion having a plurality of pixels;

a cumulative data storage unit for storing a cumulative light-emission frequency data of each of the plurality of pixels in corresponding one of a plurality of memories;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein each of the plurality of the pixels emits light having any one of a plurality of colors, wherein the cumulative light-emission frequency data is divided into a plurality of data fragments, wherein each of the plurality of the data fragments is corresponded to at least one of the plurality of the colors, and wherein each of the plurality of the data fragments is stored in corresponding one of the plurality of memories.

2. The display device according to claim 1, wherein the cumulative light-emission frequency data is any one of a cumulative data of light-emission time of each of the plurality of pixels, and a cumulative data of the light-emission time and intensity of each of the plurality of pixels.

3. The display device according to claim 1, wherein the plurality of colors are red, green and blue.

4. The display device according to claim 3, wherein the plurality of the data fragments consist of a first data fragment and a second data fragment, wherein the first data fragment is corresponded to red and green, and wherein the second data fragment is corresponded to blue.

5. The display device according to claim 1 further comprising:

a gate signal line driver circuit electrically connected to the pixel portion; and a source signal line driver circuit electrically connected to the pixel portion.

6. An electronic appliance comprising the display device according to claim 1, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

7. A display device comprising:

a pixel portion having a plurality of pixels;

a cumulative data storage unit for storing a cumulative light-emission frequency data of each of the plurality of pixels in corresponding one of a first memory and a second memory;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein each of the plurality of the pixels emits light having any one of a plurality of colors, wherein the cumulative light-emission frequency data is divided into a plurality of data fragments, wherein each of the plurality of the data fragments is corresponded to at least one of the plurality of the colors, and wherein each of the plurality of the data fragments is stored in corresponding one of the first memory and the second memory.

8. The display device according to claim 7, wherein the cumulative light-emission frequency data is any one of a cumulative data of light-emission time of each of the plurality of pixels, and a cumulative data of the light-emission time and intensity of each of the plurality of pixels.

9. The display device according to claim 7, wherein the plurality of colors are red, green and blue.

10. The display device according to claim 9, wherein the plurality of the data fragments consist of a first data fragment and a second data fragment, wherein the first data fragment is corresponded to red and green, and wherein the second data fragment is corresponded to blue.

11. The display device according to claim 7 further comprising:

a gate signal line driver circuit electrically connected to the pixel portion; and a source signal line driver circuit electrically connected to the pixel portion.

12. An electronic appliance comprising the display device according to claim 7, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

13. A display device comprising:

a pixel portion having a plurality of pixels;

a cumulative data storage unit for storing a cumulative light-emission frequency data of each of the plurality of pixels in corresponding one of a first volatile memory and a second volatile memory;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein each of the plurality of the pixels emits light having any one of a plurality of colors, wherein the cumulative light-emission frequency data is divided into a plurality of data fragments, wherein each of the plurality of the data fragments is corresponded to at least one of the plurality of the colors, and wherein each of the plurality of the data fragments is stored in corresponding one of the first volatile memory and the second volatile memory.

14. The display device according to claim 13, wherein the cumulative light-emission frequency data is any one of a cumulative data of light-emission time of each of the plurality of pixels, and a cumulative data of the light-emission time and intensity of each of the plurality of pixels.

15. The display device according to claim 13, wherein the plurality of colors are red, green and blue.

16. The display device according to claim 15, wherein the plurality of the data fragments consist of a first data fragment and a second data fragment, wherein the first data fragment is corresponded to red and green, and wherein the second data fragment is corresponded to blue.

17. The display device according to claim 13 further comprising:

a gate signal line driver circuit electrically connected to the pixel portion; and a source signal line driver circuit electrically connected to the pixel portion.

18. An electronic appliance comprising the display device according to claim 13, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

19. A display device comprising:

a pixel portion having a plurality of pixels;

a cumulative data storage unit for storing a cumulative light-emission frequency data of each of the plurality of pixels in corresponding one of a first volatile memory and a second volatile memory;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein each of the plurality of the pixels emits light having any one of a plurality of colors, wherein the cumulative light-emission frequency data is divided into a plurality of data fragments, wherein each of the plurality of the data fragments is corresponded to at least one of the plurality of the colors, wherein each of the plurality of the data fragments is stored in corresponding one of the first volatile memory and the second volatile memory, and wherein each of the plurality of the data fragments is divided into a high-order bit and a low-order bit when the cumulative light-emission frequency data is added to the light-emission frequency data.

20. The display device according to claim 19, wherein the cumulative light-emission frequency data is any one of a cumulative data of light-emission time of each of the plurality of pixels, and a cumulative data of the light-emission time and intensity of each of the plurality of pixels.

21. The display device according to claim 19, wherein the plurality of colors are red, green and blue.

22. The display device according to claim 21, wherein the plurality of the data fragments consist of a first data fragment and a second data fragment, wherein the first data fragment is corresponded to red and green, and wherein the second data fragment is corresponded to blue.

23. The display device according to claim 19 further comprising:

a gate signal line driver circuit electrically connected to the pixel portion; and a source signal line driver circuit electrically connected to the pixel portion.

24. An electronic appliance comprising the display device according to claim 19, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

25. A display device comprising:

a pixel portion having a plurality of pixels;

a cumulative data storage unit for storing a cumulative light-emission frequency data of each of the plurality of pixels in corresponding one of a plurality of memories;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein the plurality of the pixels are divided into a plurality of groups, wherein each of the plurality of the groups is corresponded to any one of a plurality of display region, wherein the cumulative light-emission frequency data is divided into a plurality of data fragments, wherein each of the plurality of the data fragments is corresponded to at least one of the plurality of the groups, and wherein each of the plurality of the data fragments is stored in corresponding one of the plurality of memories.

26. The display device according to claim 25, wherein the cumulative light-emission frequency data is any one of a cumulative data of light-emission time of each of the plurality of pixels, and a cumulative data of the light-emission time and intensity of each of the plurality of pixels.

27. The display device according to claim 25, wherein the first display region is a region where odd-numbered video data is inputted, and the second display region is a region where even-numbered video data is inputted.

28. The display device according to claim 25 further comprising:

a gate signal line driver circuit electrically connected to the pixel portion; and a source signal line driver circuit electrically connected to the pixel portion.

29. An electronic appliance comprising the display device according to claim 25, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

30. A display device comprising:

a pixel portion having a plurality of pixels;

a cumulative data storage unit for storing a cumulative light-emission frequency data of each of the plurality of pixels in corresponding one of a first memory and a second memory;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein the plurality of the pixels are divided into a plurality of groups, wherein the plurality of the groups comprises a first group corresponded to a first display region and a second group corresponded to a second display region, wherein the cumulative light-emission frequency data is divided into a plurality of data fragments, wherein each of the plurality of the data fragments is corresponded to any one of the first group and the second group, and wherein each of the plurality of the data fragments is stored in corresponding one of the first memory and the second memory.

31. The display device according to claim 30, wherein the cumulative light-emission frequency data is any one of a cumulative data of light-emission time of each of the plurality of pixels, and a cumulative data of the light-emission time and intensity of each of the plurality of pixels.

32. The display device according to claim 30, wherein the first display region is a region where odd-numbered video data is inputted, and the second display region is a region where even-numbered video data is inputted.

33. The display device according to claim 30 further comprising:

a gate signal line driver circuit electrically connected to the pixel portion; and a source signal line driver circuit electrically connected to the pixel portion.

34. An electronic appliance comprising the display device according to claim 30, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

35. A display device comprising:

a pixel portion having a plurality of pixels;

a cumulative data storage unit for storing a cumulative light-emission frequency data of each of the plurality of pixels in corresponding one of a first volatile memory and a second volatile memory;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein the plurality of the pixels are divided into a plurality of groups, wherein the plurality of the groups comprises a first group corresponded to a first display region and a second group corresponded to a second display region, wherein the cumulative light-emission frequency data is divided into a plurality of data fragments, wherein each of the plurality of the data fragments is corresponded to any one of the first group and the second group, and wherein each of the plurality of the data fragments is stored in corresponding one of the first volatile memory and the second volatile memory.

36. The display device according to claim 3, wherein the cumulative light-emission frequency data is any one of a cumulative data of light-emission time of each of the plurality of pixels, and a cumulative data of the light-emission time and intensity of each of the plurality of pixels.

37. The display device according to claim 35, wherein the first display region is a region where odd-numbered video data is inputted, and the second display region is a region where even-numbered video data is inputted.

38. The display device according to claim 35 further comprising:

a gate signal line driver circuit electrically connected to the pixel portion; and a source signal line driver circuit electrically connected to the pixel portion.

39. An electronic appliance comprising the display device according to claim 35, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

40. A display device comprising:

a pixel portion having a plurality of pixels;

a cumulative data storage unit for storing a cumulative light-emission frequency data of each of the plurality of pixels in corresponding one of a first volatile memory and a second volatile memory;

an adder for adding a light-emission frequency data of each of the plurality of pixels detected by sampling a corrected video data supplied to the pixel portion to the cumulative light-emission frequency data of each of the plurality of pixels stored in the cumulative data storage unit, and for writing to the cumulative data storage unit, a result of the adding, as a new cumulative light-emission frequency data; and a correction unit for correcting a video data based on the cumulative light-emission frequency data stored in the cumulative data storage unit, and for outputting the corrected video data to the pixel portion, wherein the plurality of the pixels are divided into a plurality of groups, wherein the plurality of the groups comprises a first group corresponded to a first display region and a second group corresponded to a second display region, wherein the cumulative light-emission frequency data is divided into a plurality of data fragments, wherein each of the plurality of the data fragments is corresponded to any one of the first group and the second group, wherein each of the plurality of the data fragments is stored in corresponding one of the first volatile memory and the second volatile memory, and wherein each of the plurality of the data fragments is divided into a high-order bit and a low-order bit when the cumulative light-emission frequency data is added to the light-emission frequency data.

41. The display device according to claim 40, wherein the cumulative light-emission frequency data is any one of a cumulative data of light-emission time of each of the plurality of pixels, and a cumulative data of the light-emission time and intensity of each of the plurality of pixels.

42. The display device according to claim 40, wherein the first display region is a region where odd-numbered video data is inputted, and the second display region is a region where even-numbered video data is inputted.

43. The display device according to claim 40 further comprising:

a gate signal line driver circuit electrically connected to the pixel portion; and a source signal line driver circuit electrically connected to the pixel portion.

44. An electronic appliance comprising the display device according to claim 40, wherein the electronic appliance is one selected from the group consisting of a television receiver set, a computer, a portable phone, a digital still camera, a display of a desktop, floor-stand or wall-hung type, a video recorder of a view finder type and/or a direct view type, a navigation system, a video phone, a goggle display, an audio reproducing device, a game machine, a portable information terminal, and an image reproducing device provided with a recording medium.

* * * * *